US009804519B2

(12) United States Patent
Suzumura et al.

(10) Patent No.: US 9,804,519 B2
(45) Date of Patent: Oct. 31, 2017

(54) METHOD FOR PRODUCING TONER

(71) Applicant: CANON KABUSHIKI KAISHA, Tokyo (JP)

(72) Inventors: Yoshitaka Suzumura, Mishima (JP); Yusuke Hasegawa, Suntou-gun (JP); Tomohisa Sano, Mishima (JP); Satoshi Arimura, Toride (JP); Takuma Ikejiri, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/366,295

(22) Filed: Dec. 1, 2016

(65) Prior Publication Data

US 2017/0160656 A1 Jun. 8, 2017

(30) Foreign Application Priority Data

Dec. 4, 2015 (JP) ..... 2015-237858
Oct. 25, 2016 (JP) ..... 2016-208362

(51) Int. Cl.
*G03G 9/093* (2006.01)
*G03G 9/09* (2006.01)
(Continued)

(52) U.S. Cl.
CPC ..... *G03G 9/0926* (2013.01); *G03G 9/0804* (2013.01); *G03G 9/0825* (2013.01); *G03G 9/08711* (2013.01); *G03G 9/091* (2013.01)

(58) Field of Classification Search
CPC ..... G03G 9/08755; G03G 9/08782; G03G 9/093; G03G 9/081
See application file for complete search history.

(56) References Cited

U.S. PATENT DOCUMENTS 6,586,151 B1 7/2003 Naka et al.
6,803,164 B2 10/2004 Mizoo et al.
(Continued)

FOREIGN PATENT DOCUMENTS

EP 2 818 931 12/2014
JP 2004-184561 7/2004
(Continued)

OTHER PUBLICATIONS

Translation of JP 2006-065015 published Aug. 2004.*
(Continued)

*Primary Examiner* — Peter Vajda
(74) *Attorney, Agent, or Firm* — Fitzpatrick Cella Harper and Scinto

(57) ABSTRACT

A method for producing a toner containing a toner particle containing a binder resin, a colorant and a crystalline substance, wherein the method includes the steps of: (I) setting a temperature of a dispersion, in which a coloring particle is dispersed with an aqueous medium, to $T_A$(° C.), which is higher than the higher of a crystallization temperature Tc(° C.) of the crystalline substance and a glass transition temperature Tg(° C.) of the coloring particle, the coloring particle containing the binder resin, the colorant and the crystalline substance; (II) cooling the dispersion from the $T_A$ to a temperature equal to or lower than the Tg at a cooling rate of at least 5.0° C./min after the step (I); and (III) holding the dispersion in a temperature from Tg−10 to Tg+10 for at least 30 min after the step (II).

7 Claims, 7 Drawing Sheets

(51) Int. Cl.
*G03G 9/08* (2006.01)
*G03G 9/087* (2006.01)

(56) References Cited

U.S. PATENT DOCUMENTS

| | | | |
|---|---|---|---|
| 6,953,646 | B2 | 10/2005 | Doujo et al. |
| 7,123,862 | B2 | 10/2006 | Hasegawa et al. |
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,704,659 | B2 | 4/2010 | Ogawa et al. |
| 7,811,734 | B2 | 10/2010 | Ogawa et al. |
| 7,923,190 | B2 | 4/2011 | Magome et al. |
| 7,935,467 | B2 | 5/2011 | Dojo et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 8,518,620 | B2 | 8/2013 | Dojo et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,918,035 | B2 | 12/2014 | Hasegawa et al. |
| 9,029,055 | B2 | 5/2015 | Aoki et al. |
| 9,097,997 | B2 | 8/2015 | Nomura et al. |
| 9,152,065 | B2 | 10/2015 | Sano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,377,708 | B2 | 6/2016 | Magome et al. |
| 9,417,542 | B2 | 8/2016 | Hiroko et al. |
| 9,423,710 | B2 | 8/2016 | Magome et al. |
| 9,423,711 | B2 | 8/2016 | Uratani et al. |
| 9,454,096 | B2 | 9/2016 | Hasegawa et al. |
| 9,551,947 | B2 | 1/2017 | Hiroko et al. |
| 2009/0123863 | A1* | 5/2009 | Ashizawa ..... G03G 9/081 430/109.4 |
| 2009/0197192 | A1 | 8/2009 | Hiroko et al. |
| 2010/0159381 | A1* | 6/2010 | Takagi ..... G03G 9/0804 430/109.4 |
| 2015/0227067 | A1 | 8/2015 | Hasegawa et al. |
| 2015/0227068 | A1 | 8/2015 | Sano et al. |
| 2016/0139521 | A1 | 5/2016 | Tsuda et al. |
| 2016/0154331 | A1 | 6/2016 | Tanaka et al. |
| 2016/0266509 | A1 | 9/2016 | Sano et al. |
| 2016/0378003 | A1 | 12/2016 | Arimura et al. |

FOREIGN PATENT DOCUMENTS

| | | | | |
|---|---|---|---|---|
| JP | 2006-065015 | * | 8/2004 | ..... G03G 9/087 |
| JP | 2009-104193 | | 5/2009 | |
| JP | 2015-028616 | | 2/2015 | |

OTHER PUBLICATIONS

U.S. Appl. No. 15/256,780, Yusuke Hasegawa, filed Sep. 6, 2016.
U.S. Appl. No. 15/259,114, Yoshitaka Suzumura, filed Sep. 8, 2016.
U.S. Appl. No. 15/259,293, Yoshitaka Suzumura, filed Sep. 8, 2016.
U.S. Appl. No. 15/361,583, Yuujirou Nagashima, filed Nov. 28, 2016.
U.S. Appl. No. 15/362,992, Satoshi Arimura, filed Nov. 29, 2016.
U.S. Appl. No. 15/416,055, Takashi Matsui, filed Jan. 26, 2017.

* cited by examiner

METHOD FOR PRODUCING TONER

BACKGROUND OF THE INVENTION

Field of the Invention

The present invention relates to a method for producing a toner that is used in, for example, electrophotographic methods, electrostatic recording methods, and magnetic recording methods.

Description of the Related Art

Image-forming apparatuses, e.g., copiers, printers, and so forth, have in recent years been subjected to increasing diversification with regard to their intended applications and their use environment, and along with this ever greater energy savings are being required. Toner that presents additional improvements in the low-temperature fixability is the first consideration from the standpoint of toner-based improvements in energy savings.

Crystalline substances, e.g., waxes, are used in order to improve the low-temperature fixability of toners. The crystalline substance melts at the melting point exhibited by such a material and plasticizes the binder resin used in the toner and thereby promotes melting and deformation of the toner. As a consequence, the low-temperature fixability of a toner can be further enhanced by lowering the melting point of the crystalline substance and/or increasing the amount of use of the crystalline substance.

On the other hand, the storability of a toner in a high-temperature, high-humidity environment is increasingly impaired as the low-temperature fixability is enhanced. Since the crystalline substance plasticizes the binder resin in the toner, when the toner is left to stand in a high-temperature environment, for example, at 50° C., the crystalline substance outmigrates to the toner surface and the toner then coalesces with another toner and this produces the storability-related problem of toner blocking.

As a result, a trade-off relationship between the low-temperature fixability and the storability is set up when enhancements are sought in the low-temperature fixability through the use of a crystalline substance.

The low-temperature fixability can be enhanced by controlling the state in which the crystalline substance is present in the toner interior. For example, the low-temperature fixability is enhanced for a state in which the crystalline substance is dispersed in the toner interior, in comparison to that for a state in which it is present aggregated without dispersion.

In Japanese Patent Application Laid-open No. 2009-104193, inter alia, the low-temperature fixability is enhanced by causing the crystalline substance to be dispersed in the toner interior through an increase in the cooling rate.

On the other hand, in relation to the storability, a method in which the degree of crystallinity of the crystalline substance in the toner interior is increased is described in Japanese Patent Application Laid-open No. 2015-28616.

However, there is still room for additional improvements in order to overcome the trade off described above, i.e., avoiding a loss of storability while enhancing the low-temperature fixability.

SUMMARY OF THE INVENTION

The present invention provides a method for producing a toner that can raise the degree of crystallinity in combination with causing the crystalline substance to be dispersed in the toner interior.

The present invention is a method for producing a toner containing a toner particle containing a binder resin, a colorant, and a crystalline substance, wherein the method includes the steps of:

(I) setting a temperature of a dispersion, in which a coloring particle is dispersed with an aqueous medium, to $T_A$(° C.), the $T_A$(° C.) being higher than the higher of a crystallization temperature Tc(° C.) of the crystalline substance and a glass transition temperature Tg(° C.) of the coloring particle, the coloring particle containing the binder resin, the colorant, and the crystalline substance;

(II) cooling the dispersion from the $T_A$ to a temperature equal to or lower than the Tg at a cooling rate of at least 5.0° C./min after the step (I); and (III) holding the dispersion in a temperature range of at least Tg−10(° C.) and not more than Tg+10(° C.) for at least 30 min after the step (II).

Further features of the present invention will become apparent from the following description of exemplary embodiments with reference to the attached drawings.

DESCRIPTION OF THE EMBODIMENTS

The toner production method of the present invention has the following steps: (I) setting a temperature of a dispersion, in which a coloring particle is dispersed with an aqueous medium, to $T_A$(° C.), the $T_A$(° C.) being higher than the higher of a crystallization temperature Tc(° C.) of the crystalline substance and a glass transition temperature Tg(° C.) of the coloring particle, the coloring particle containing the binder resin, the colorant, and the crystalline substance; (II) cooling the dispersion from the $T_A$ to a temperature equal to or lower than the Tg at a cooling rate of at least 5.0° C./min after the step (I); and (III) holding the dispersion in a temperature range of at least Tg−10(° C.) and not more than Tg+10(° C.) for at least 30 min after the step (II).

The present invention is a toner production method that has a step of bringing about crystal growth of the crystalline substance by holding in a specific temperature region; this step is carried out after a dispersion having the coloring particle dispersed in an aqueous medium is rapidly cooled at a cooling rate of at least 5.0° C./minute from a specific temperature to a temperature equal to or lower than the glass transition temperature Tg (° C.) of the coloring particle.

The binder resin present in the coloring particle and the crystalline substance uniformly melt when the coloring particle is brought to a temperature $T_A$ that is higher than the higher of the crystallization temperature Tc (° C.) of the crystalline substance and the glass transition temperature Tg (° C.) of the coloring particle.

When rapid cooling is carried out from this molten state, the binder resin undergoes solidification while the state when melted is maintained as such. Due to this, a state is assumed in which the crystalline substance and binder resin are intertwined at the molecular level, i.e., they are present in a "compatibilized state".

Figure 1:
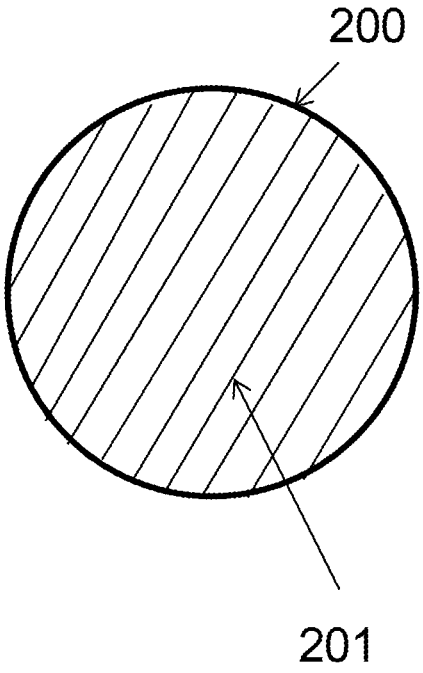
FIG. 1 is a schematic diagram that shows the toner cross section for a state in which the crystalline substance is compatibilized.

FIG. 1 is a diagram that schematically shows the toner cross section when the crystalline substance and binder resin are in a compatibilized state, wherein regions (domains hereafter) in which only the crystalline substance is present cannot be observed. In FIG. 1, 200 refers to the toner cross section and 201 refers to the crystalline substance compatibilized in the binder resin.

Such a state of occurrence for the crystalline substance supports an excellent low-temperature fixability; however, during standing in a high-temperature environment, the compatibilized crystalline substance proceeds to outmigrate to the toner surface while crystallizing and the storability undergoes a substantial decline as a result.

Figure 2:
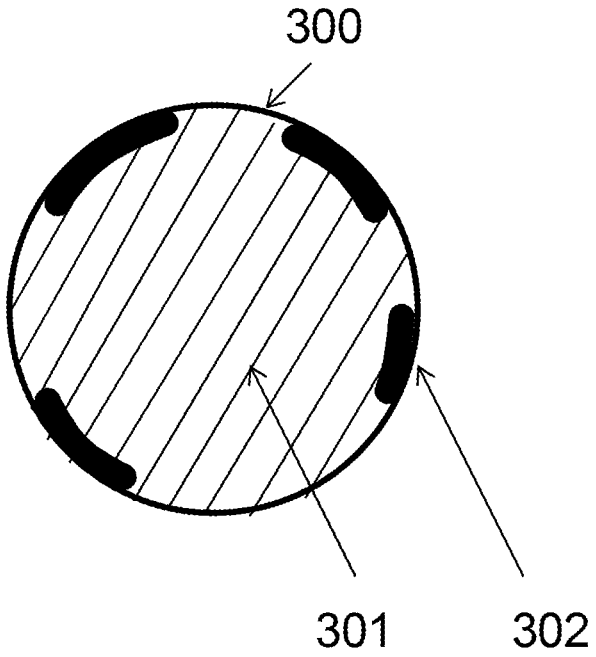
FIG. 2 is a schematic diagram that shows a state after standing at high temperature, in which the crystalline substance has outmigrated to the toner surface.

FIG. 2 is a diagram that schematically shows the toner cross section in a state in which the crystalline substance has outmigrated to the toner surface when holding in a high-temperature environment has been carried out. In FIG. 2, 300 refers to the toner cross section; 301 refers to the crystalline substance compatibilized in the binder resin; and 302 refers to the crystalline substance that has outmigrated to the toner surface.

In addition, the crystalline substance in the vicinity of the center of the toner and at the toner surface undergoes crystal growth when crystal growth of the crystalline substance is promoted by cooling at a gradual cooling rate from a temperature at which the crystalline substance and binder resin can be uniformly melted to around the glass transition temperature of the coloring particle, and holding at this temperature.

On the other hand, crystal growth of the crystalline substance is promoted by holding for a specific period of time in the interval of the glass transition temperature (Tg) of the coloring particle ±10° C. after rapidly cooling from a specific temperature at a cooling rate of at least 5.0° C./minute. The present inventors discovered that nuclei of the crystalline substance are formed in large numbers in the toner interior by going through this step.

Figure 3:
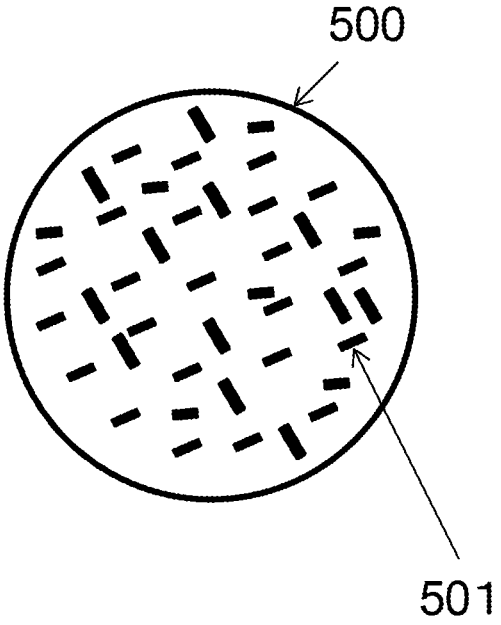
FIG. 3 is a schematic diagram that shows a state in which the crystalline substance is dispersed formed into a large number of microdomains.

FIG. 3 is a diagram that schematically shows the toner interior provided by the present invention.

FIG. 3 shows that a large number of microdomains of the crystalline substance are present dispersed in the toner interior. The toner provided by the present invention is characterized in that the crystalline substance is almost entirely absent from the toner surface and the storability is therefore excellent. In FIG. 3, 500 refers to the toner cross section and 501 refers to a microdomain of the crystalline substance.

In addition, the degree of crystallinity of the crystalline substance in the toner interior is very high and is stable and as a consequence, even in the case of standing in a harsh environment to provide a more rigorous evaluation of the storability, outmigration of the crystalline substance to the toner surface is substantially suppressed.

Moreover, the low-temperature fixability is substantially enhanced since the crystalline substance forms a large number of microdomains in the toner interior. The toner thusly provided by the present invention makes it possible for the low-temperature fixability to co-exist with the storability at high levels for each.

The reason for the formation of a large number of nuclei of the crystalline substance in the toner interior is thought to be as follows.

By cooling in step (II) to a temperature equal to or lower than the Tg (° C.), the binder resin can be solidified with the crystalline substance left compatibilized.

By then holding for a specific period of time in the interval of the Tg (° C.) ±10° C., crystal nuclei of the crystalline substance are formed throughout the interior of the toner and crystal growth can also be brought about. As a consequence, the crystalline substance compatibilized in the toner interior undergoes crystallization with these crystal nuclei as starting points. Since the compatibilized crystalline substance can undergo crystal growth based on crystal nuclei that are present throughout, the amount of crystalline substance remaining in the toner present in the compatibilized state becomes very small.

The presence in the toner interior of crystalline substance formed into a large number of microdomains can be brought about by this mechanism in the case of toner produced using the present invention. The toner has a very good low-temperature fixability as a result.

Since crystal growth of the crystalline substance compatibilized in the binder resin is promoted using a large number of crystal nuclei of the crystalline substance, the amount of compatibilized crystalline substance remaining in the toner interior is very small. This results in a very good toner storability.

When, on the other hand, crystal nuclei of the crystalline substance are not used, and even when crystallization of the crystalline substance is additionally promoted over a long period of time, it is difficult for crystal growth to occur in the crystal line substance that is separated from the crystalline substance domains that form the starting points for crystal growth and crystal line substance compatibilized in the binder resin then remains. This results in a reduction in the storability.

The crystalline substance preferably satisfies the following (i) and/or (ii):

(i) a melting point Tm (° C.) is at least 50° C. and not more than 90° C.; and (ii) a weight-average molecular weight (Mw) is at least 1,000, and a ratio [Mw/Mn] of its weight-average molecular weight (Mw) to its number-average molecular weight (Mn) is at least 1.6.

Both the crystalline substance and the binder resin present in the coloring particle melt at the temperature $T_A$ in the present invention.

The melting point Tm (° C.) of the crystalline substance is more preferably at least 60° C. and not more than 85° C.

When the melting point Tm (° C.) is at least 50° C., plasticization of the binder resin by the crystalline substance proceeds to an appropriate degree and the storability is improved. Melting of both the binder resin and the crystalline substance in the aqueous medium is easily brought about when, on the other hand, the melting point Tm (° C.) is not more than 90° C.

The weight-average molecular weight (Mw) of the crystalline substance is more preferably at least 1,500 in the present invention. In addition, this weight-average molecular weight (Mw) is preferably not more than 4,000.

On the other hand, the ratio [Mw/Mn] for the crystalline substance of its weight-average molecular weight (Mw) to its number-average molecular weight (Mn) is more preferably at least 1.8. This [Mw/Mn] is also preferably not more than 10.0.

In order to adjust this [Mw/Mn] into the indicated range, different monomers having different monomer carbon chains are used in place of a portion of the monomer used as the starting material, thereby producing a composition distribution for the obtained crystalline substance and enabling control of the [Mw/Mn].

When the molecular weight distribution of the crystalline substance has a certain degree of breadth, the low molecular weight crystalline substance behaves like a cosolvent with the binder resin in a high-temperature aqueous medium. Due to this, the binder resin and the crystalline substance can be efficiently melted even in an aqueous medium for which the boiling point is 100° C.

The crystalline substance preferably satisfies at least one of the above-described conditions (i) and (ii) in the present invention and can be exemplified by known waxes and crystalline polyesters.

The waxes can be exemplified by the following:

aliphatic hydrocarbon waxes such as low molecular weight polyethylene, low molecular weight polypropylene, microcrystalline wax, Fischer-Tropsch waxes, and paraffin waxes; oxides of aliphatic hydrocarbon waxes, such as oxidized polyethylene wax, and their block copolymers; waxes in which the major component is fatty acid ester, such as carnauba wax and montanic acid ester waxes, and waxes provided by the partial or complete deacidification of fatty acid esters, such as deacidified carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinylic monomer such as styrene or acrylic acid; partial esters between a polyhydric alcohol) and a fatty acid, such as behenic monoglyceride; and hydroxy group-containing methyl ester compounds obtained, for example, by the hydrogenation of plant oils.

When a wax is used in the present invention, an aliphatic hydrocarbon wax or an ester wax is preferred and an ester wax is more preferred.

The ester wax is a crystalline wax having the ester bond in the molecule. The ester bond readily functions as a starting point for formation of the aforementioned crystal nuclei.

For example, when an ester wax and a crystalline polyester are used, the interaction between the ester bond present in the ester wax and the ester bond present in the crystalline polyester facilitates the development of crystal growth of the crystalline polyester with the ester wax functioning as crystal nuclei. An increase in the degree of crystallinity of the crystalline polyester is also made possible due to this. The structure of the ester wax more preferably has a plural number of ester bonds within the molecule.

The number of ester bonds is preferably at least 2 and not more than 6 and is more preferably at least 2 and not more than 4.

Ester waxes having a structure that contains a single ester bond in the molecule can be exemplified by ester compounds of a $C_{6-12}$ aliphatic monoalcohol with a long-chain aliphatic monocarboxylic acid, and ester compounds of a $C_{4-10}$ aliphatic monocarboxylic acid with a long-chain aliphatic monoalcohol. While these aliphatic monocarboxylic acids and aliphatic monoalcohols can be exemplified by any aliphatic monocarboxylic acid and aliphatic monoalcohol, the monomer combination should be able to satisfy the melting point of the present invention.

The aliphatic monoalcohol can be exemplified by 1-hexanol, 1-heptanol, 1-octanol, 1-nonanol, 1-decanol, undecyl alcohol, and lauryl alcohol. The aliphatic monocarboxylic acid can be exemplified by pentanoic acid, hexanoic acid, heptanoic acid, octanoic acid, nonanoic acid, and decanoic acid.

Ester waxes having a structure that contains two ester bonds in the molecule can be exemplified by ester compounds of a dibasic carboxylic acid with an aliphatic monoalcohol, and ester compounds of a dihydric alcohol with an aliphatic monocarboxylic acid.

The dibasic carboxylic acid can be exemplified by adipic acid, pimelic acid, suberic acid, azelaic acid, decanedioic acid, and dodecanedioic acid.

The dihydric alcohol can be exemplified by 1,6-hexanediol, 1,7-heptanediol, 1,8-octanediol, 1,9-nonanediol, 1,10-decanediol, 1,11-undecanediol, and 1,12-dodecanediol.

Straight-chain carboxylic acids and straight-chain alcohols have been provided as examples here, but branched structures may also be present.

The aliphatic monoalcohols for condensation with the dibasic carboxylic acids can be exemplified by, above all, tetradecanol, pentadecanol, hexadecanol, heptadecanol, octadecanol, nonadecanol, eicosanol, docosanol, tricosanol, tetracosanol, pentacosanol, hexacosanol, and octacosanol.

The aliphatic monocarboxylic acids for condensation with the dihydric alcohols can be exemplified by lauric acid, myristic acid, palmitic acid, margaric acid, stearic acid, tuberculostearic acid, arachidic acid, behenic acid, lignoceric acid, and cerotic acid.

Ester waxes having a structure that contains three ester bonds in the molecule can be exemplified by ester compounds of a glycerol compound with an aliphatic monocarboxylic acid. Ester waxes containing four ester bonds in the molecule can be exemplified by ester compounds of pentaerythritol with an aliphatic monocarboxylic acid, and ester compounds of diglycerol with an aliphatic monocarboxylic acid. Ester waxes containing five ester bonds in the molecule can be exemplified by ester compounds of triglycerol with an aliphatic monocarboxylic acid. Ester waxes containing six ester bonds in the molecule can be exemplified by ester compounds of dipentaerythritol with an aliphatic monocarboxylic acid, and ester compounds of tetraglycerol with an aliphatic monocarboxylic acid. Ester waxes containing at least two ester bonds in the molecule are preferred in the present invention, and specific examples in this regard are ester compounds of a dibasic or higher basic carboxylic acid with an aliphatic monoalcohol, and ester compounds of a dihydric or polyhydric alcohol with an aliphatic monocarboxylic acid.

Known crystalline polyesters can be used for the crystalline polyester in the present invention, but the condensate of an aliphatic dicarboxylic acid with an aliphatic diol is preferred. In addition, saturated crystalline polyesters are preferred.

The following are examples of monomers that can be used when the crystalline polyester is a condensation polymer from an aliphatic dicarboxylic acid and an aliphatic diol and is a saturated polyester:

the aliphatic dicarboxylic acid can be exemplified by oxalic acid, malonic acid, succinic acid, glutaric acid, adipic acid, pimelic acid, suberic acid, azelaic acid, sebacic acid (decanedioic acid), and dodecanedioic acid;

the aliphatic diol can be exemplified by ethylene glycol, diethylene glycol, triethylene glycol, propylene glycol, dipropylene glycol, trimethyl ene glycol, neopentyl glycol, 1,4-butanediol, 1,6-hexanediol, 1,7-heptanediol, 1,8-octanediol, 1,9-nonanediol, 1,10-decanediol, 1,11-undecanediol, and 1,12-dodecanediol.

The crystalline polyester preferably has a weight-average molecular weight (Mw) of at least 1,000 and not more than 60,000 and more preferably at least 20,000 and not more than 50,000. The reason for this is that this enables the plasticizing effect by the crystalline polyester to be rapidly obtained in the fixing step while keeping a high degree of crystallinity for the crystalline polyester.

The weight-average molecular weight (Mw) of the crystalline polyester can be controlled using the various conditions in the production of the crystalline polyester.

The crystalline polyester may be a block polymer of a crystalline polyester segment and a vinyl polymer segment. A block polymer is defined as a polymer structured of a plurality of linearly connected blocks (The Society of Polymer Science, Japan; Glossary of Basic Terms in Polymer Science by the Commission on Macromolecular Nomenclature of the International Union of Pure and Applied Chemistry), and the present invention also operates according to this definition.

There are no particular limitations on the binder resin in the present invention, and the known resins used in toners as indicated below can be used as the binder resin.

The following can be used: homopolymers of styrene and substituted styrenes, e.g., polystyrene and polyvinyltoluene; styrene copolymers, e.g., styrene-propylene copolymer, styrene-vinyltoluene copolymer, styrene-vinylnaphthalene copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; styrene-acrylic resins such as styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, and styrene-dimethylaminoethyl methacrylate copolymer; as well as polymethyl methacrylate, polybutyl methacrylate, polyvinyl acetate, polyethylene, polypropylene, polyvinyl butyral, silicone resin, polyester resin, polyamide resin, epoxy resin, and polyacrylic acid resin. A single one of these can be used or a combination of a plurality of species can be used.

The glass transition temperature Tg (° C.) of the binder resin is preferably at least 47° C. and not more than 65° C. in the present invention. A glass transition temperature Tg (° C.) in the indicated range is preferred because this facilitates an adequate crystallization of the crystalline substance in the treatment of the present invention.

The weight-average molecular weight (Mw) of the binder resin is preferably at least 6,000 and not more than 100,000 in the present invention and is more preferably at least 10,000 and not more than 60,000.

The ratio of the weight-average molecular weight (Mw) of the binder resin to the weight-average molecular weight (Mw) of the crystalline substance is preferably at least 19.0 and is more preferably at least 22.0. The upper limit on this ratio, on the other hand, is about 40.0, at which point the effect therefrom is saturated.

A ratio of at least 19.0 facilitates crystallization of the crystalline substance in the treatment steps of the present invention.

The binder resin in the present invention preferably contains at least 50 mass % and not more than 100 mass % of a styrene-acrylic resin and more preferably contains at least 80 mass % and not more than 100 mass %. Styrene-acrylic resins tend to readily undergo phase separation from the crystalline substance and due to this the crystalline substance crystallizes in a dispersed state in the toner and a toner is readily obtained in which the crystalline substance is not exposed at the toner surface.

The polymerizable monomer that forms this styrene-acrylic resin can be exemplified by the following:

styrenic polymerizable monomer can be exemplified by styrene, α-methylstyrene, o-methylstyrene, m-methylstyrene, p-methylstyrene, and p-methoxystyrene;

acrylate ester polymerizable monomer cart be exemplified by methyl acrylate, ethyl acrylate, n-propyl acrylate, isopropyl acrylate, n-butyl acrylate, isobutyl acrylate, tert-butyl acrylate, n-hexyl acrylate, 2-ethylhexyl acrylate, n-octyl acrylate, and cyclohexyl acrylate; and methacrylate ester polymerizable monomer can be exemplified by methyl methacrylate, ethyl methacrylate, n-propyl methacrylate, isopropyl methacrylate, n-butyl methacrylate, isobutyl methacrylate, tert-butyl methacrylate, n-hexyl methacrylate, 2-ethylhexyl methacrylate, and n-octyl methacrylate.

A single one of these polymerizable monomers can be used or a mixture can be used.

In addition, the content of the styrenic monomer in the polymerizable monomer is preferably at least 55 mass % and not more than 90 mass % and is more preferably at least 65 mass % and not more than 80 mass %. On the other hand, the content of the acrylate ester monomer and methacrylate ester monomer is preferably at least 10 mass % and not more than 45 mass % and is more preferably at least 20 mass % and not more than 35 mass %.

There are no particular limitations on the method for producing the styrene-acrylic resin and known methods can be used. In addition, when the binder resin in the present invention contains a styrene-acrylic resin, combinations with known resins other than the styrene-acrylic resin can also be used.

The coloring particle in the present invention preferably contains an amorphous resin C which is different from the binder resin at at least 1 mass part and not more than 10 mass parts (more preferably at least 2 mass parts and not more than 8 mass parts) per 100 mass parts of the binder resin, and the glass transition temperature Tgc (° C.) of this amorphous resin C is preferably at least 10° C. (more preferably at least 15° C. and not more than 30° C.) higher than the glass transition temperature Tg (° C.) of the coloring particle.

By incorporating the amorphous resin C having a glass transition temperature at least 10° C. higher than the glass transition temperature Tg (° C.) of the coloring particle, the amorphous resin C is already solidified prior to the solidification of the binder resin in step (II). As a result, inhibition of the molecular motion of the crystalline substance within the coloring particle is facilitated. Due to this, the number of domains of the crystalline substance within the toner is substantially increased and the low-temperature fixability is further enhanced.

The amorphous resin C can be selected from among the resins provided above as examples of the binder resin, but is preferably a styrene-acrylic resin.

The glass transition temperature Tgc (° C.) of this amorphous resin C is preferably at least 57° C. and not more than 90° C. and is more preferably at least 65° C. and not more than 80° C.

The weight-average molecular weight (Mw) of the amorphous resin C is preferably at least 6,000 and not more than 100,000 and is more preferably at least 10,000 and not more than 60,000.

The colorant used in the present invention is not particularly limited and can be exemplified by the following organic pigments, organic dyes, and inorganic pigments.

Cyan colorants can be exemplified by copper phthalocyanine compounds and derivatives thereof, anthraquinone compounds, and basic dye lake compounds.

Magenta colorants can be exemplified by the following:

condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Yellow colorants can be exemplified by condensed azo compounds, isoindolinone compounds, anthraquinone compounds, azo-metal complexes, methine compounds, and allylamide compounds.

Black colorants may be, for example, a carbon black or a black colorant provided by color mixing to yield black using the yellow colorants, magenta colorants, and cyan colorants described above.

A single one or a mixture of these colorants may be used, and the colorant can be used in the form of a solid solution. The colorant used in the present invention is selected considering the hue angle, chroma, lightness, lightfastness, OHP transparency, and dispersibility in the toner particle.

The colorant content is preferably at least 1 mass part and not more than 20 mass parts per 100 mass parts of the binder resin.

When a magnetic body is used as a colorant in the present invention, this magnetic body can be exemplified by iron oxides such as magnetite, maghemite, and ferrite, and iron oxides that contain another metal oxide, and by metals such as Fe, Co, and Ni, as well as alloys of these metals with a metal such as Al, Co, Cu, Pb, Mg, Ni, Sn, Zn, Sb, Ca, Mn, Se, or Ti, and mixtures of the preceding.

Specific examples are iron(II,III) oxide ($FeO_4$), ferric oxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$).

The BET specific surface area of the magnetic body by the nitrogen adsorption method is preferably at least 2.0 $m^2/g$ and not more than 30.0 $m^2/g$ and is more preferably at least 3.0 $m^2/g$ and not more than 28.0 $m^2/g$.

The Mohs hardness is preferably at least 5 and not more than 7. The shape of the magnetic body is, for example, polyhedral, octahedral, hexahedral, spherical, acicular, or scale shape, and a low-anisotropy magnetic body, e.g., polyhedral, octahedral, hexahedral, spherical, and so forth, is preferred from the standpoint of increasing the image density.

The magnetic body preferably has a number-average particle diameter of at least 0.10 μm and not more than 0.40 μm from the standpoint of the color and uniform dispersity in the toner. Generally, a smaller particle diameter for the magnetic body, while raising the tinting strength, also facilitates aggregation of the magnetic body.

The number-average particle diameter of the magnetic body can be measured using a transmission electron microscope. Specifically, the toner to be observed is thoroughly dispersed in an epoxy resin and curing is carried out for 2 days in an atmosphere with a temperature of 40° C. A thin-section sample is prepared from the obtained cured material using a microtome; a cross-sectional image is acquired at a magnification of 10,000× to 40,000× using a transmission electron microscope (TEM); and the particle diameters of 100 magnetic bodies are measured in the cross-sectional image. The number-average particle diameter is determined based on the equivalent diameter of the circle that is equal to the projected area of the magnetic body. The particle diameter can also be measured using an image analyzer.

A single magnetic body may be used or two or more species may be used in combination.

The content of the magnetic body, per 100 mass parts of the binder resin, is preferably at least 20.0 mass parts and not more than 150.0 mass parts and is more preferably at least 50.0 mass parts and not more than 1.00.0 mass parts.

The magnetic body content can be measured using a thermal analyzer (instrument name: TGA7, by PerkinElmer Co., Ltd.). The measurement method is as follows.

The toner is heated from normal temperature to 900° C. at a ramp rate of 25° C./minute under a nitrogen atmosphere. The amount of the binder resin is taken to be the mass loss between 100° C. and 750° C., and the residual mass is taken to be approximately the amount of the magnetic body.

The toner in the present invention may use a charge control agent in order to maintain a stable charging behavior regardless of the environment.

Known charge control agents can be used, and a charge control agent that supports a fast charging speed and maintains a stable and constant amount of charge is particularly preferred.

Negative-charging charge control agents can be exemplified by the following:

monoazo metal compounds; acetylacetone metal compounds; metal compounds of aromatic oxycarboxylic acids, aromatic dicarboxylic acids, oxycarboxylic acids, and dicarboxylic acids; aromatic oxycarboxylic acids and aromatic mono- and polycarboxylic acids and their metal salts, anhydrides, and esters; phenol derivatives such as bisphenol; urea derivatives; metal-containing salicylic acid compounds; metal-containing naphthoic acid compounds; boron compounds; quaternary ammonium salts; calixarene; and resin-based charge control agents.

The positive-charging charge control agents can be exemplified by the following:

nigrosine and nigrosine modifications by, for example, a fatty acid metal salt; guanidine compounds; imidazole compounds; quaternary ammonium salts such as tributylbenzylammonium 1-hydroxy-4-naphthosulfonate salt and tetrabutylammonium tetrafluoroborate, and the onium salts, such as phosphonium salts, that are analogues of the preceding, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; and resin-based charge control agents.

A single one of the preceding may be used or combinations of two or more may be used.

Among the preceding, metal-containing salicylic acid compounds are preferred outside of the resin-based charge control agents, and metal-containing salicylic acid compounds in which the metal is aluminum or zirconium are particularly preferred and an aluminum salicylate compound is even more preferred.

A polymer or copolymer that has a sulfonic acid group, sulfonate salt group, or sulfonate ester group, a salicylic acid segment, or a benzoic acid segment is preferably used for the resin-based charge control agent.

The content of the charge control agent, per 100 mass parts of the binder resin, is preferably at least 0.01 mass parts and not more than 20.0 mass parts and is more preferably at least 0.05 mass parts and not more than 10.0 mass parts.

The weight-average particle diameter (D4) of the toner produced by the present invention is preferably at least 3.0 μm and not more than 12.0 m and is more preferably at least 4.0 μm and not more than 10.0 μm. When the weight-average particle diameter (D4) is at least 3.0 μm and not more than 12.0 μm, an excellent flowability is obtained and the latent image can be faithfully developed.

Any known method may be used for the method for producing the coloring particle in the present invention.

When, for example, production is carried out using a pulverization method, the binder resin, colorant, crystalline substance, and other optional additives are thoroughly mixed using a mixer such as a Henschel mixer or a ball mill. This is followed by dispersing or melting the various starting materials by melt kneading using a heated kneader, e.g., a hot roll, kneader, or extruder, and the coloring particle is then obtained by proceeding through a cooling and solidification step, a pulverization step, a classification step, and optionally a surface treatment step.

A known pulverizing apparatus, e.g., a mechanical impact type or a jet type, may be used in the pulverization step. In addition, either of the classification step and surface treatment step may precede the other in the sequence. A multigrade classifier is preferably used in the classification step from the standpoint of production efficiency.

When the coloring particle is produced by a dry method such as a pulverization method, after the coloring particle has been obtained a specific process may be carried out that includes a cooling step, infra, after the coloring particle has been dispersed in an aqueous medium to provide a dispersion.

When at this time the coloring particle is heated in the aqueous medium, a known surfactant, organic dispersing agent, or inorganic dispersing agent may be used as a dispersing agent, as described below, in order to inhibit coalescence. In the present invention, the dispersion under consideration preferably contains a poorly water-soluble inorganic dispersing agent.

Poorly water-soluble inorganic dispersing agents are preferred because they suppress the production of ultrafine powder; because they provide dispersion stability through steric hindrance, which makes the stability resistant to disruption even when the reaction temperature is changed; and because washing is also easy and exercising adverse effects on the toner is thus suppressed. Moreover, a poorly water-soluble inorganic dispersing agent is even more preferred because it has a high polarity and suppresses the precipitation of the crystalline substance, which is hydrophobic, on the toner surface.

Suspension polymerization methods and emulsion aggregation methods are advantageous examples of methods for producing the coloring particle. Production of the coloring particle using a suspension polymerization method or emulsion aggregation method is easily incorporated into the production process since the coloring particle is then produced in an aqueous dispersion. These production methods facilitate sharpening of the particle size distribution of the coloring particle and increasing the average circularity of the coloring particle. They also enable the realization of a coloring particle that has a core/shell structure.

The details are provided below of an example of the production of the coloring particle using a suspension polymerization method, but this should not be construed as indicating a limitation to or by this.

A method for producing the coloring particle using a suspension polymerization method is as follows.

First, a polymerizable monomer composition is obtained by dissolving or dispersing the following to uniformity: the polymerizable monomer constituting the binder resin, the colorant, the crystalline substance, and optionally a polymerization initiator, crosslinking agent, charge control agent, and other additives.

Using a suitable stirrer, this polymerizable monomer composition is then dispersed in a continuous phase (for example, an aqueous medium) that contains a dispersing agent to form particles of the polymerizable monomer composition in the aqueous medium.

The polymerizable monomer contained in the polymerizable monomer composition particle is subsequently polymerized to obtain a coloring particle having a desired particle diameter.

With regard to the stirring intensity by the stirrer, the intensity may be selected considering, for example, the dispersibility of the starting materials and the productivity.

With regard to the timing for the addition of the polymerization initiator, it may be added at the same time as the addition of the polymerizable monomer and other additives or may be mixed immediately prior to the dispersion of the polymerizable monomer composition in the aqueous medium. In addition, the polymerization initiator, dissolved in the polymerizable monomer or a solvent, may also be added immediately after the polymerizable monomer composition particle has been formed and prior to the start of the polymerization reaction.

The polymerization temperature for polymerization of the polymerizable monomer should be set to at least 40° C. and generally at least 50° C. and not more than 90° C.

The polymerizable monomer here can be exemplified by the polymerizable monomer provided as examples of the polymerizable monomer for forming the styrene-acrylic resin as described above.

The polymerization initiator is preferably a polymerization initiator that has a half-life of at least 0.5 hours and not more than 30 hours during the polymerization reaction. In addition, when the polymerization reaction is run using an amount of addition that is at least 0.5 mass parts and not more than 20 mass parts per 100 mass parts of the polymerizable monomer, a polymer can then be obtained that has a maximum between molecular weights of 5,000 and 50,000.

Examples of specific polymerization initiators are azo or diazo polymerization initiators, e.g., 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile, and peroxide polymerization initiators, e.g., benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate, and t-butyl peroxypivalate.

A compound having at least two polymerizable double bonds is mainly used as the aforementioned crosslinking agent. Examples are aromatic divinyl compounds such as divinylbenzene and divinylnaphthalene; carboxylate esters having two double bonds, such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds that have three or more vinyl groups. A single one of these may be used or a mixture of two or more may be used.

The amount of addition of the crosslinking agent is preferably at least 0.1 mass parts and not more than 10.0 mass parts per 100 mass parts of the polymerizable monomer.

A known surfactant, organic dispersing agent, or poorly water-soluble inorganic dispersing agent can be used as the aforementioned dispersing agent. A poorly water-soluble inorganic dispersing agent is preferred in the present invention. These inorganic dispersing agents can be exemplified by multivalent metal salts of phosphoric acid, e.g., tricalcium phosphate, magnesium phosphate, aluminum phosphate, zinc phosphate, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

The surfactant can be exemplified by sodium dodecylbenzene sulfate, sodium tetradecyl sulfate, sodium pentadecyl sulfate, sodium octyl sulfate, sodium oleate, sodium laurate, sodium stearate, and potassium stearate. The amount of addition of the inorganic dispersing agent is preferably at least 0.2 mass parts and not more than 20.0 mass parts per 100 mass parts of the polymerizable monomer. A single one of these dispersing agents may be used by itself or a plural number of species may be used in combination. In addition, the surfactant may be co-used at at least 0.1 mass parts and not more than 10.0 mass parts.

In the case of use of these inorganic dispersing agents, they may be used as such or, in order to obtain even finer particles, they may also be used by producing particles of the inorganic dispersing agent in the aqueous medium. For example, in the case of tricalcium phosphate, water-insoluble calcium phosphate can be produced by mixing an aqueous sodium phosphate solution with an aqueous calcium chloride solution under high-speed stirring, and this makes possible a more uniform and finer dispersion.

When the coloring particle is produced using a suspension polymerization method or an emulsion aggregation method, the coloring particle is then obtained in a state of dispersion in an aqueous medium, and because of this a specific process containing the cooling step described below may be carried out without a break.

Steps (I), (II), and (III) are described below while providing specific examples, but the present invention is not limited to or by these.

Figure 4:
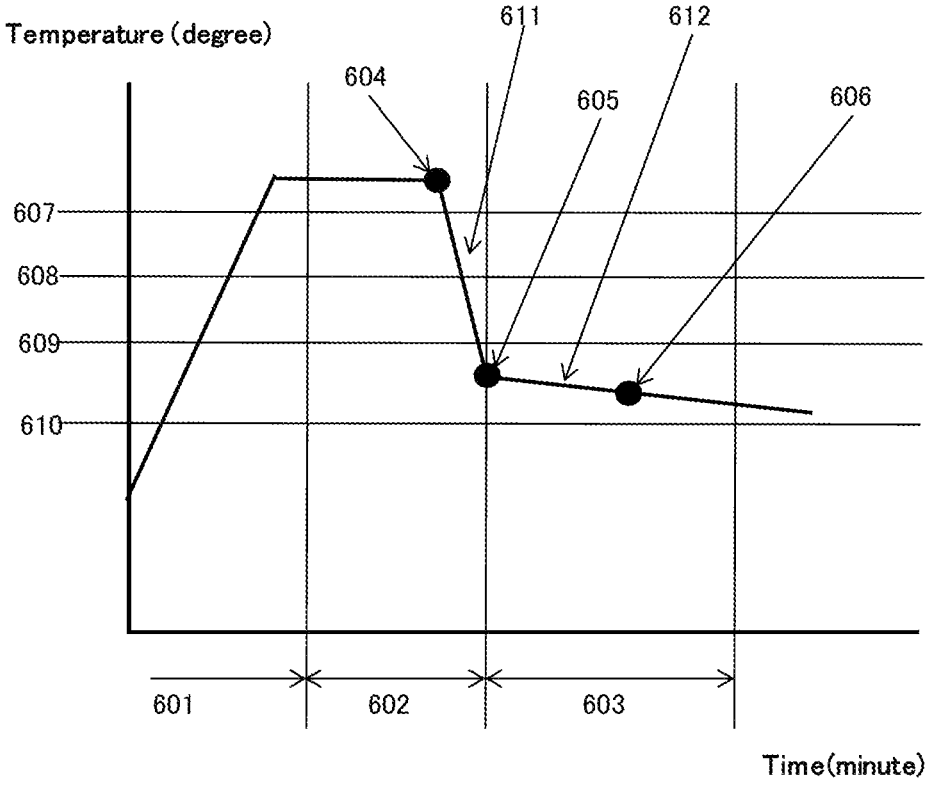
FIG. 4 is a diagram that shows an example of the temperature transitions in the treatment steps.

FIG. 4 schematically illustrates the temperature transitions in steps (I), (II), and (III) for a dispersion in which the coloring particle is dispersed in an aqueous medium.

In FIG. 4, 601 shows step (I), 602 shows step (II), and 603 shows step (III).

609 gives the glass transition temperature Tg (° C.) of the coloring particle, and 607 gives the crystallization temperature Tc (° C.) of the crystalline substance.

In step (I), the temperature of the dispersion is brought to a temperature $T_A$ that is higher than the higher of the crystallization temperature Tc (° C.) of the crystalline substance and the glass transition temperature Tg (° C.) of the coloring particle.

604 shows the temperature immediately prior to cooling of the dispersion and is designated the starting temperature T1.

605 shows the temperature immediately after the completion of cooling of the dispersion and is designated the stopping temperature T2.

The temperature of the dispersion is then held in step (III) in order to promote the formation and growth of crystal nuclei of the crystalline substance. 608 and 610 are lines that show, respectively, the Tg+10° C. and the Tg−10° C. 605 is the holding start temperature T3, and 606 shows the temperature T4 of the dispersion at the time point at which 30 minutes have elapsed from the start of step (III). 611 show the cooling rate 1 going from T1 to T2, and 612 show the cooling rate 2 going from T3 to T4. The cooling rate 1 and the cooling rate 2 are calculated using the following formulas.

$$\text{cooling rate 1}=(T1(^\circ\text{C.})-T2(^\circ\text{C.}))/\text{time (minutes) required for cooling}$$

$$\text{cooling rate 2}=(T3(^\circ\text{C.})-T4(^\circ\text{C.}))/30\ \text{(minutes)}$$

Step (I) is a step in which the dispersion of the coloring particle—which contains the binder resin, colorant, and crystalline substance—dispersed in an aqueous medium is brought to the temperature $T_A$. The crystalline substance and the binder resin can be mixed together at the molecular level by the execution of this operation.

When, for example, the coloring particle has been produced by a polymerization method in an aqueous medium, this operation becomes unnecessary when the corresponding polymerization temperature exceeds the temperature that is the higher of the crystallization temperature Tc (° C.) of the crystalline substance and the glass transition temperature Tg (° C.) of the coloring particle.

In addition, the dispersion is preferably held at the temperature $T_A$ for a prescribed period of time with the objective of achieving a more uniform melting of the crystalline substance and binder resin present in the coloring particle. This holding time is preferably at least 30 minutes and is more preferably at least 90 minutes and is even more preferably at least 120 minutes. The upper limit on this holding time, on the other hand, is considered to be about 1,440 minutes, at which point its effect is saturated.

By executing the treatments in an aqueous medium when the treatments of step (II) and step (III) are carried out, the crystalline substance, which is hydrophobic, is confined in the interior of the toner. Due to this, the presence of the crystalline substance at the surface of the obtained toner can be suppressed.

When, on the other hand, step (II) or (III) is carried out in the air, an oxygen atmosphere, a nitrogen atmosphere, or a high-humidity atmosphere, the crystalline substance, since it is hydrophobic, crystallizes at the toner surface and the storability is impaired.

Similarly, when step (III) is made the same as a drying step, for the same reason the crystalline substance crystallizes at the toner surface and the storability is impaired.

When the coloring particle is produced by a dry method, e.g., pulverization, the obtained coloring particle should be dispersed in an aqueous medium to obtain a dispersion. When the coloring particle is produced by a wet method, e.g., a suspension polymerization method or an emulsion aggregation method, the coloring particle is then already dispersed in an aqueous medium and the dispersion of the coloring particle in an aqueous medium again is thus not required.

Step (II) is a step in which the dispersion in which the coloring particle is dispersed is cooled at a cooling rate of at least 5.0° C./minute from the temperature $T_A$ to a temperature equal to or lower than the Tg (° C.) (preferably to less than the Tg (° C.) and more preferably to not more than the Tg−3° C.).

The temperature $T_A$ preferably is a temperature that is at least 5° C. and not more than 22° C. (more preferably at least 10° C. and not more than 22° C.) higher than the higher of the crystallization temperature Tc (° C.) of the crystalline substance and the glass transition temperature Tg (° C.) of the coloring particle.

Moreover, the crystallization temperature Tc (° C.) preferably is a temperature that is at least 10° C. higher (more preferably at least 15° C. and not more than 40° C. and even more preferably at least 15° C. and not more than 30° C.) than the glass transition temperature Tg (° C.).

Greater control of the state of dispersion and degree of crystallinity of the crystalline substance in the toner is facilitated and an even better low-temperature fixability and storability are then provided when the crystallization temperature Tc (° C.) is a temperature at least 10° C. higher than the glass transition temperature Tg (° C.) and when the temperature of the dispersion is cooled at a cooling rate of at least 5.0° C./minute from a temperature that is at least 5° C. and not more than 22° C. higher than the crystallization temperature Tc (° C.), to a temperature equal to or lower than the Tg (° C.).

The glass transition temperature Tg (° C.) of the toner may be used in steps (I), (II) and (III) for the glass transition temperature Tg (° C.) of the coloring particle.

The means used to rapidly cool the temperature of the dispersion can be, for example, an operation in which cold water and/or ice is mixed, an operation in which the dispersion is bubbled with a cold air current, or an operation in which the heat of the dispersion is removed using a heat exchanger.

When rapid cooling at a cooling rate of at least 5.0° C./minute is carried out as described above, a state can be generated in which a large number of microdomains of the crystalline substance are dispersed in the interior of the toner. In addition, the number-average diameter of the major diameter of the crystalline substance domains can be controlled to at least 5 nm and not more than 500 nm. Moreover, the number of crystalline substance domains of at least 5 nm and not more than 500 nm present in the toner cross section, see below, can be controlled to at least 20.

Microdomains that satisfy this range make it possible during toner fixing for the crystalline substance to selectively soften the toner at small amounts of heat and thus provide a very good low-temperature fixability.

When the cooling rate is less than 5.0° C./minute, not enough crystal nuclei of the crystalline substance will be produced in step (III) and the major diameter of the crystalline substance domains will be larger than 500 nm. The low-temperature fixability and storability of the obtained toner will decline as a result.

This cooling rate is preferably at least 55.0° C./minute and is more preferably at least 95.0° C./minute. On the other hand, the upper limit on this cooling rate is about 3,000° C./minute, at which point its effect is saturated.

Step (III) is a step in which the dispersion that has gone through step (II) is held for at least 30 minutes in the temperature region of at least the Tg−10° C. and not more than the Tg+10° C. (preferably the dispersion is held in the temperature region of at least the Tg−5° C. and not more than the Tg+5° C.).

In this step, the degree of crystallinity is improved by the generation of crystal nuclei of the crystalline substance and its crystal growth in the interior of the coloring particle. The generation of crystal nuclei and crystal growth cart be carried out in the above-described temperature region relative to the glass transition temperature Tg (° C.) of the coloring particle. By holding the temperature of the dispersion in this temperature region, the molecules of the crystalline substance, while undergoing motion to a small degree, begin to form crystal nuclei. With further holding of the temperature, the crystalline substance molecules undergo additional movement and the just formed crystal nuclei function as starting points and crystal growth is carried out.

The holding time is taken to be the amount of time that the temperature of the dispersion is within the range of the above-described temperature region. In order to bring about a sufficient increase in the degree of crystallinity, the holding time is to be at least 30 minutes. A preferred holding time is at least 90 minutes and a more preferred time is at least 1.20 minutes. On the other hand, the upper limit on this holding time is about 1,440 minutes, at which point its effects are saturated.

When the stopping temperature T2 for cooling is lower than the range of the above-described temperature region, holding of the temperature may be carried out after the dispersion has been reheated to provide the range of the above-described temperature region.

In the event of deviation from the above-described temperature region during the course of carrying out step (III), control into this temperature region may be exercised by readjusting the temperature of the dispersion. In this case, the cumulative time during which this temperature region is satisfied is taken to be the holding time, and the toner of the present invention can be obtained as long as the holding time is at least 30 minutes.

When holding is carried out in the temperature region below the Tg−10° C., the binder resin ends up undergoing a thorough solidification and as a consequence the compatibilized crystalline substance cannot form crystal nuclei and the effects of the present invention are then not obtained.

Moreover, when holding is carried out in the temperature region above the Tg+10° C., the binder resin does not undergo solidification and due to this the storability undergoes a large decline in the same manner as for toner not subjected to the rapid cooling in step (II).

Because the formation of crystal nuclei of the crystalline substance and its crystal growth are phenomena that are promoted by control into a certain prescribed temperature region, the dispersion may be cooled in step (III) in the temperature region of at least the Tg−10° C. and not more than the Tg+10° C., at a cooling rate of not more than 0.70° C./minute (preferably not more than 0.40° C./minute and more preferably not more than 0.20° C./minute).

The ratio of the cooling rate 2 to the cooling rate 1 in the present invention is preferably at least 0.00 and not more than 0.05 and is more preferably at least 0.00 and not more than 0.02. When this range is used, in step (III) the crystalline substance compatibilized in the binder resin during the cooling of step (II) forms very numerous crystal nuclei and as a result the amount of the dispersed crystalline substance is increased and along with this the degree of crystallinity is further improved. A very good low-temperature fixability and storability are provided as a consequence.

In order to control the cooling rate 2 and the ratio of the cooling rate 2 to the cooling rate 1 into the prescribed ranges, the temperature of the aqueous medium that has gone through step (II) may be controlled so as to satisfy the prescribed temperature region. The effects of the present invention cannot be obtained, for example, in the case of standing at room temperature, without controlling the temperature of the aqueous medium that has gone through step (II).

A toner particle is obtained by subjecting the coloring particle that has gone through steps (I), (II), and (III) to filtration, washing, and drying using known methods.

As necessary, the toner particle may be made into a toner by the addition and mixing of, for example, an external additive, in order to attach this to the surface. Known methods can be used to mix the external additive. Mixing using a Henschel mixer is an example.

The coarse powder and fines present in the toner particle may also be removed by inserting a classification step in the production sequence (prior to mixing the external additive).

The external additive is preferably an inorganic fine particle having a number-average primary particle diameter of at least 4 nm and not more than 80 nm (more preferably at least 6 nm and not more than 40 nm).

The number-average primary particle diameter of the inorganic fine particle can be measured using a photograph of the magnified toner taken with a scanning electron microscope.

The inorganic fine particle is added in order to improve the flowability of the toner and provide a uniform toner chargeability; however, functions such as improving the environmental stability and adjusting the amount of toner charge may also be provided by subjecting the inorganic fine particle to a hydrophobic treatment. The treatment agent used in the hydrophobic treatment can be exemplified by treatment agents such as silicone varnishes, variously modified silicone varnishes, silicone oils, variously modified silicone oils, silane compounds, silane coupling agents, other organosilicon compounds, and organotitanium compounds. A single one of these may be used by itself, or two or more species may be used in combination.

The inorganic fine particle can be exemplified by silica fine particles, titanium oxide fine particles, and alumina fine particles. For example, both so-called dry silica fine particles known as dry-method or fumed silica and produced by the vapor-phase oxidation of a silicon halide, and so-called wet silica fine particles produced from, e.g., water glass, can be used as the silica fine particles.

A composite fine particle of silica with another metal oxide can also be obtained by the use in the production process of another metal halide compound, e.g., aluminum chloride, titanium chloride, and so forth, together with the silicon halide compound, and this is also encompassed by the dry silica fine particles.

The amount of addition of the inorganic fine particle is preferably at least 0.1 mass % and not more than 3.0 mass % with reference to the toner particle.

Figure 6:
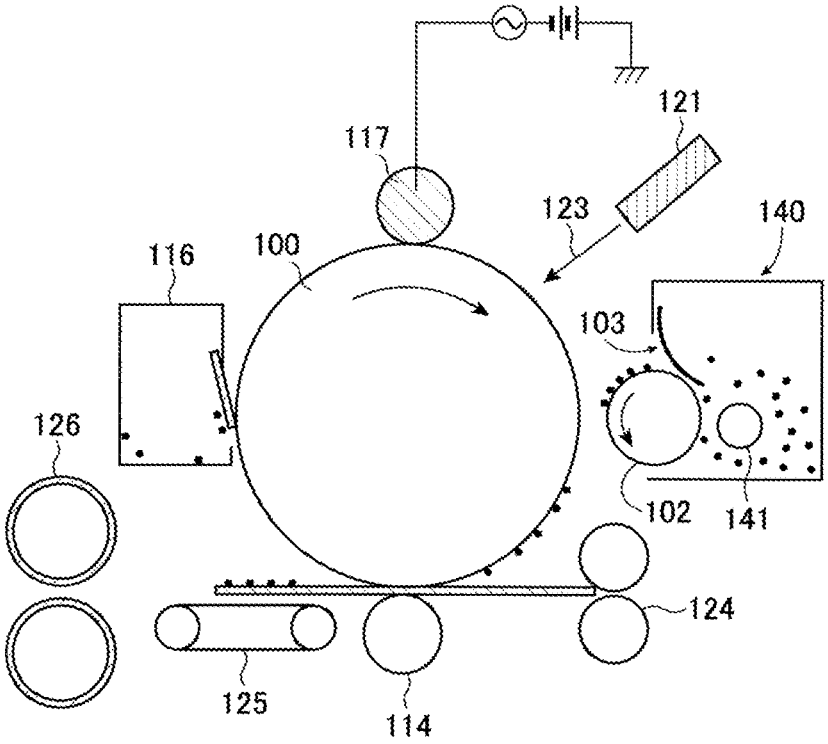
FIG. 6 is a diagram that shows an example of an image-forming apparatus.

An example of an image-forming apparatus that can advantageously use the toner will be specifically described using FIG. 6. In FIG. 6, 100 is an electrostatic latent image-bearing member (also referred to in the following as a photosensitive member), and, for example, the following are disposed on its circumference: a charging member (charging roller) 117; a developing device 140 having a toner-carrying member 102, a developing blade 103, and a stirring member 141; a transfer member (transfer charging roller) 114; a cleaner container 116; a fixing unit 126; a pick-up roller 124; and a transport belt 125.

The photosensitive member 100 is charged to, for example, −600 V (the applied voltage is, for example, an AC voltage of 1.85 kVpp or a DC voltage of −620 Vdc), by the charging roller 117. Photoexposure is carried out by irradiating the photosensitive member 100 with a laser 123 from a laser generator 121, and an electrostatic latent image that corresponds to the target image is thereby formed. The electrostatic latent image on the photosensitive member 100 is developed by a single-component toner by the developing device 140 to obtain a toner image, and the toner image is transferred onto a transfer material by the transfer charging roller 114, which contacts the photosensitive member with the transfer material interposed therebetween. The transfer material bearing the toner image is moved to the fixing unit 126 by, for example, the transport belt 125, and fixing onto the transfer material is carried out. In addition, the toner remaining in part on the photosensitive member is cleaned off by the cleaner container 116. An image-forming apparatus that uses magnetic single-component jumping development is illustrated here, but this may be an image-forming apparatus used in either a jumping development method or a contact development method.

The methods for measuring the individual properties pertaining to the present invention are described in the following.

<Method for Measuring the Weight-Average Particle Diameter (D4) of the Toner Particle or the Toner>

The weight-average particle diameter (D4) is determined as follows. The measurement instrument used is a "Coulter Counter Multisizer 3" (registered trademark, from Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of approximately 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1,600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of deionized water is introduced into the water tank of this ultrasound disperser and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner particle or the toner is added to the aqueous electrolyte solution in small portions and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

<Method for Measuring the Molecular Weight of the Crystalline Substances and the Molecular Weight of the Resins>

The molecular weight of the crystalline substances and the molecular weight of the resins are measured proceeding as follows using gel permeation chromatography (GPC).

First, the sample is dissolved in tetrahydrofuran (THF) at room temperature. The obtained solution is filtered across a "Sample Pretreatment Cartridge" solvent-resistant membrane filter with a pore diameter of 0.2 μm (by Tosoh Corporation) to obtain the sample solution. The sample solution is adjusted to a THF-soluble component concentration of 0.8 mass %. The measurement is performed under the following conditions using this sample solution.

instrument: "HLC-8220GPC" high-performance GPC instrument [by Tosoh Corporation]
column: 2×LF-604 [by Showa Denko K.K.]
eluent: THF
flow rate: 0.6 mL/minute
oven temperature: 40.0° C.
sample injection amount: 0.020 mL The molecular weight calibration curve constructed using polystyrene resin standards (product name: "TSK Standard Polystyrene F-850, F-450, F-288, F-128, F-80, F-40, F-20, F-10, F-4, F-2, F-1, A-5000, A-2500, A-1000, and A-500", by Tosoh Corporation) is used to calculate the molecular weight of the sample. This calibration curve is used to calculate the weight-average molecular weight (Mw) and the number-average molecular weight (Mn) of the crystalline substances and the weight-average molecular weight (Mw) of the resins. The weight-average molecular weight (Mw) of the toner can also be calculated using the same method.

<Method for Calculating the Outmigration Ratio of the Crystalline Substance at the Toner Surface>

The outmigration ratio to the toner surface by the crystalline substance is used as an indicator that quantitates the storability of the toner. The toner is stained with ruthenium and the outmigration ratio for the crystalline substance is calculated using a scanning electron microscope (SEM).

When the toner is stained with ruthenium, the crystal line substance present in the toner is more resistant to staining than the amorphous resin used for the binder resin, and due to this a clear contrast is obtained and observation is easily performed. The amount of the ruthenium atom changes as a function of the strength/weakness of staining, and as a result these atoms are present in large amounts in a strongly stained region and transmission of the electron beam then does not occur and white appears on the observed image. The electron beam is readily transmitted in weakly stained regions, which then appear in black on the observed image.

The outmigration ratio of the crystalline substance is calculated in the present invention by subjecting the toner surface image—acquired using a Hitachi S-4800 (by Hitachi High-Technologies Corporation) ultrahigh-resolution scanning electron microscope—to analysis with Image-Pro Plus ver. 5.0 (by Nippon Roper K.K.) image analysis software. The image acquisition conditions with the S-4800 are as follows.

(1) Specimen Preparation

An electroconductive paste is spread in a thin layer on the specimen stub (15 mm×6 mm aluminum specimen stub) and the toner is sprayed onto this. Additional blowing with air is performed to remove excess toner from the specimen stub and carry out thorough drying. The specimen stub is set in the specimen holder and the specimen stub height is adjusted to 36 mm with the specimen height gauge. Using a vacuum electronic staining device (VSC4R1H, Filgen, Inc.), the toner is stained for 15 minutes in a 500 Pa $RuO_4$ gas atmosphere.

(2) Setting the Conditions for Observation with the S-4800

The outmigration ratio for the crystalline substance is calculated using the image obtained by backscattered electron imaging with the S-4800. The outmigration ratio for the crystalline substance can be measured with excellent accuracy using the backscattered electron image because the inorganic fine particles are charged up less than is the case with the secondary electron image.

Liquid nitrogen is introduced to the brim of the anti-contamination trap located in the S-4800 housing and standing is carried out for 30 minutes. The "PC-SEM" of the S-4800 is started and flashing (the FE tip, which is the electron source, is cleaned) is performed. The acceleration voltage display area in the control panel on the screen is clicked and the [flashing] button is pressed to open the flashing execution dialog. A flashing intensity of 2 is confirmed and execution is performed. An emission current due to flashing of 20 to 40 μA is confirmed. The specimen holder is inserted in the specimen chamber of the S-4800 housing. [Home] on the control panel is pressed to transfer the specimen holder to the observation position.

The acceleration voltage display area is clicked to open the HV setting dialog and the acceleration voltage is set to [0.8 kV] and the emission current is set to [20 μA]. In the [base] tab of the operation panel, signal selection is set to [SE]; [upper(U)] and [+BSE] are selected for the SE detector; and [L.A. 100] is selected in the selection box to the right of [+BSE] to go into the observation mode using the backscattered electron image. Similarly, in the [base] tab of the operation panel, the probe current of the electron optical system condition block is set to [Normal]; the focus mode is set to [UHR]; and WD is set to [3.0 mm]. The [ON] button in the acceleration voltage display area of the control panel is pushed and the acceleration voltage is applied.

(3) Calculation of the Number-Average Particle Diameter (D1) of the Toner

The magnification is set to 5,000× (5 k) by dragging within the magnification display area of the control panel. The [COARSE] focus knob on the operation panel is turned and adjustment of the aperture alignment is performed where some degree of focus has been obtained. [Align] in the control panel is clicked and the alignment dialog is displayed and [beam] is selected. The displayed beam is migrated to the center of the concentric circles by turning the STIGMA/ALIGNMENT knobs (X, Y) on the operation panel. [aperture] is then selected and the STIGMA/ALIGNMENT knobs (X, Y) are turned one at a time and adjustment is performed so as to stop the motion of the image or minimize the motion. The aperture dialog is closed and focusing is carried out with the autofocus. Focusing is done by repeating this operation an additional two times.

After this, the number-average particle diameter (D1) is determined by measuring the particle diameter for 300 toner particles. The particle diameter of the individual particle is taken to be the major diameter when the toner particle is observed.

(4) Focus Adjustment

For the particles obtained in (3) with a number-average particle diameter (D1) ±0.1 μm, with the center of the major diameter adjusted to the center of the measurement screen, dragging is performed within the magnification display area of the control panel to set the magnification to 10,000× (10 k). The [COARSE] focus knob on the operation panel is turned and adjustment of the aperture alignment is performed where some degree of focus has been obtained. [Align] is clicked in the control panel and the alignment dialog is displayed and [beam] is selected. The displayed beam is migrated to the center of the concentric circles by turning the STIGMA/ALIGNMENT knobs (X, Y) on the operation panel. [aperture] is then selected and the STIGMA/ALIGNMENT knobs (X, Y) are turned one at a time and adjustment is performed so as to stop the motion of the image or minimize the motion. The aperture dialog is closed and focusing is carried out with autofocus. The magnification is then set to 5,000× (5 k); focus adjustment is carried out as above using the focus knob and the STIGMA/ALIGNMENT knob; and re-focusing is carried out using autofocus. Focusing is performed by repeating this operation. Here, because the accuracy of the measurement is prone to decline when the observation plane has a large tilt angle, the analysis is carried out by making a selection with the least tilt in the surface by making a selection during focus adjustment in which the entire observation plane is simultaneously in focus.

(5) Image Capture

The brightness is adjusted using the ABC mode and a photograph with a size of 640×480 pixels is taken and stored. The analysis described below is carried out using this image file. One photograph is taken for each toner particle, and SEM images are obtained for at least 30 toner particles.

(6) Image Analysis

The outmigration ratio of the crystalline substance is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter at least 50 nm is present within a partition, calculation of the outmigration ratio of the crystalline substance is not performed for this partition.

The analytic procedure with the Image-Pro Plus ver. 5.0 image analysis software is as follows.

Figure 7:
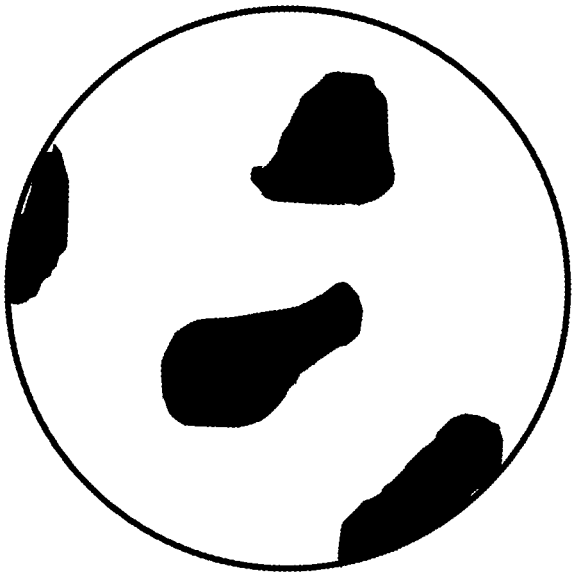
FIG. 7 is a diagram that shows the outmigration of the crystalline substance.

The SEM image is acquired by this image analysis software and a 3×3 pixel filtering process is carried out. The area A of a single toner particle is determined from the contour of the toner. A binarization process is also run within the toner contour. When this is done, the threshold calculated by automatic processing is used as the binarization threshold. The crystalline substance is identified as black, for example, as shown in FIG. 7. The area B identified as black is obtained. The outmigration ratio for the crystalline substance is calculated using the following formula.

$$\text{outmigration ratio (\%) for the crystalline substance} = \text{area } B/\text{area } A \times 100$$

The outmigration ratio for the crystalline substance is calculated as above for at least 30 toner particles. The average value of all the obtained data is taken to be the outmigration ratio for the crystalline substance.

<Method for Measuring the Glass Transition Temperature Tg (° C.) of the Toner, Coloring Particle, and Resins>

The glass transition temperature Tg (° C.) of the toner, coloring particle, and resins is measured according to ASTM D 3418-82 using a "Q1000" (by TA instruments) differential scanning calorimeter.

The melting points of indium and zinc are used for temperature correction in the instrument detection section, and the heat of fusion of indium is used for correction of the amount of heat.

Specifically, 10 mg of the sample is precisely weighed out and introduced into an aluminum pan, and, using an empty aluminum pan as the reference, measurement is carried out at a ramp rate of 10° C./minute between at least 30° C. and not more than 200° C. for the measurement range.

During this ramp process, changes are obtained in the specific heat in the range between at least 40° C. and not more than 100° C. The glass transition temperature Tg (° C.) is taken to be the temperature at the point of intersection between the curve segment for the stepwise change part at the glass transition and the straight line that is equidistant, in the direction of the vertical axis, from the straight lines formed by extending the baselines for prior to and subsequent to the appearance of the aforementioned change in the specific heat.

<Measurement of the Crystallization Temperature Tc (° C.) and the Melting Point Tm (° C.) of the Crystalline Substance>

The crystallization temperature Tc (° C.) and the melting point Tm (° C.) of the crystalline substance are measured based on ASTM D 3418-82 using a "Q1000" (by TA Instruments) differential scanning calorimeter.

Temperature correction in the instrument detection section is performed using the melting points of indium and zinc, and the amount of heat is corrected using the heat of fusion of indium.

Specifically, 10 mg of the sample is precisely weighed out and this is introduced into an aluminum pan, and the measurement is run at a ramp rate of 10° C./minute in the measurement range between at least 30° C. and not more than 200'C using an empty aluminum pan as reference.

The measurement is carried out by initially raising the temperature to 200° C. at a ramp rate of 10° C./minute, then cooling to 30° C. at a ramp down rate of 10° C./minute, and then reheating. The peak temperature of the maximum endothermic peak in the curve for the specific heat change measured at at least 30° C. and not more than 200° C. in this second ramp-up process is taken to be the melting point Tm (° C.) of the crystalline substance.

On the other hand, the crystallization temperature Tc (° C.) of the crystalline substance is taken to be the peak temperature of the maximum exothermic peak in the curve for the specific heat change measured at at least 30° C. and not more than 200° C. in the ramp-down process.

<Method for Measuring the Number-Average Diameter of the Major Diameter of the Crystalline Substance Domains>

The number-average diameter of the major diameter of the crystalline substance domains denotes the number-average diameter determined from the major diameters of the crystalline substance domains based on toner cross section images observed using a transmission electron microscope (TEM).

The toner cross section for observation with a transmission electron microscope (TEM) is prepared proceeding as follows.

When the toner is stained with ruthenium, the crystalline substance is resistant to staining and as a consequence the crystalline substance domains appear black in TEM observation and the domains can then be distinguished proceeding in this manner. At least 100 toner cross sections are observed to calculate the domain diameter. The number-average diameter is calculated for measurement of all the domains. The obtained number-average diameter is taken to be the number-average diameter of the major diameter of the crystalline substance domains.

<Method for Measuring the Number of Crystalline Substance Domains>

The number of crystalline substance domains denotes the number of domains satisfying at least 5 nm and not more than 500 nm among the domain diameters obtained in the measurement described above.

To measure the number of crystalline substance domains, the number of domains can be measured and acquired in the domain diameter measurement described above. This is carried out on at least 100 toner cross sections, and the number of domains per one toner cross section is designated as the number of crystalline substance domains.

The present invention provides a toner production method that brings about the dispersion of the crystalline substance in the interior of the toner and raises the degree of crystallinity of the crystalline substance. As a result, a toner can be produced that exhibits an excellent low-temperature fixability and that can suppress the generation of blocking and fogging before and after standing in a harsh environment.

EXAMPLES

The present invention is specifically described below using production examples and examples, but these in no way limit the present invention. Unless specifically indicated otherwise, the "parts" and "%" given in the examples and comparative examples are on a mass basis in all instances.

<Magnetic Iron Oxide Production Example>

55 L of a 4.0 mol/L aqueous sodium hydroxide solution was mixed with stirring into 50 L of an aqueous ferrous sulfate solution containing $Fe^{2+}$ at 2.0 mol/L to obtain an aqueous ferrous salt solution that contained colloidal ferrous hydroxide. An oxidation reaction was run while holding this aqueous solution at 85° C. and blowing in air at 20 L/minute to obtain a slurry that contained core particles.

The obtained slurry was filtered and washed on a filter press, after which the core particles were redispersed in water to obtain a redispersion.

To this redispersion was added sodium silicate to provide 0.20 parts as silicon per 100 parts of the core particles; the pH of the redispersion was adjusted to 6.0; and magnetic iron oxide particles having a silicon-rich surface were obtained by stirring.

The obtained slurry was filtered and washed with a filter press followed by redispersion in deionized water to obtain a redispersion.

Into this redispersion (solids fraction=50 g/L) was introduced 500 g (1.0 mass % relative to the magnetic iron oxide) of the ion-exchange resin SK110 (by Mitsubishi Chemical Corporation) and ion-exchange was carried out for 2 hours with stirring. This was followed by removal of the ion-exchange resin by filtration on a mesh; filtration and washing on a filter press; and drying and crushing to obtain a magnetic iron oxide having a number-average primary particle diameter of 0.23 μm.

<Silane Compound Production Example>

30 parts of isobutyltrimethoxysilane was added dropwise to 70 parts of deionized water while stirring. While holding this aqueous solution at pH 5.5 and a temperature of 55° C., hydrolysis of the isobutyl trimethoxysilane was carried out by dispersing for 120 minutes using a disper impeller at a peripheral velocity of 0.46 m/second.

This was followed by bringing the pH of the aqueous solution to 7.0 and cooling to 10° C. to stop the hydrolysis reaction and obtain a silane compound-containing aqueous solution.

<Magnetic Body 1 Production Example>

100 parts of the magnetic iron oxide was introduced into a high-speed mixer (Model LFS-2 by Fukae Powtec Corporation (today's Earth Technica Co., Ltd.)) and 8.0 parts of the silane compound-containing aqueous solution was added dropwise over 2 minutes while stirring at a rotation rate of 2,000 rpm. This was followed by mixing and stirring for 5 minutes.

Then, in order to raise the adherence of the silane compound, drying was carried out for 1 hour at 40° C. and, after the moisture had been reduced, the mixture was dried for 3 hours at 110° C. to develop the condensation reaction of the silane compound.

This was followed by crushing and passage through a screen having an aperture of 100 m to obtain a magnetic body 1.

<Crystalline Substance>

The designations and properties of the crystalline substances 1 to 5 used in the examples and comparative examples are given in Table 1.

TABLE 1

| crystalline substance | designation | number of ester bonds | crystallization temperature Tc (° C.) | melting point Tm (° C.) | Mw | Mw/Mn |
|---|---|---|---|---|---|---|
| crystalline substance 1 | dipentaerythritol arachidate | 6 | 74 | 76 | 1850 | 1.6 |
| crystalline substance 2 | dibehenyl sebacate | 2 | 71 | 73 | 818 | 1.4 |
| crystalline substance 3 | behenyl behenate | 1 | 71 | 72 | 636 | 1.2 |
| crystalline substance 4 | Fischer-Tropsch wax | 0 | 75 | 78 | 469 | 1.2 |
| crystalline substance 5 | dipentaerythritol lignocerate | 6 | 92 | 93 | 2354 | 1.8 |

<Amorphous Resin C>

The resin names and properties of the amorphous resins C-1, C-2, and C-3 used in the examples and comparative examples are given in Table 2.

TABLE 2

| amorphous resin | resin name | Mw | glass transition temperature Tgc (° C.) |
|---|---|---|---|
| resin C-1 | styrene-acrylic resin | 45000 | 70 |
| resin C-2 | styrene-acrylic resin | 30000 | 65 |
| resin C-3 | styrene-acrylic resin | 17000 | 60 |

The compositions of amorphous resins C-1, C-2, and C-3 are as follows.

amorphous resin C-1: copolymer of styrene (85 parts) and butyl acrylate (15 parts)

amorphous resin C-2: copolymer of styrene (82 parts) and butyl acrylate (18 parts)

amorphous resin C-3: copolymer of styrene (79 parts) and butyl acrylate (21 parts)

<Toner 1 Production Example>

450 parts of a 0.1 mol/L aqueous $Na_3PO_4$ solution was introduced into 720 parts of deionized water; heating to 60° C. was carried out; and 67.7 parts of a 1.0 mol/L aqueous $CaCl_2$ solution was added to obtain an aqueous medium that contained a dispersing agent.

styrene 79.0 parts n-butyl acrylate 21.0 parts divinylbenzene 0.6 parts resin C-1 3.0 parts iron complex of monoazo dye (T-77: by Hodogaya Chemical Co., Ltd.) 1.5 parts magnetic body 1 90.0 parts This formulation was dispersed and mixed to uniformity using an attritor (by Nippon Coke & Engineering Co., Ltd.) to obtain a polymerizable monomer composition. This polymerizable monomer composition was heated to 63° C. and 10 parts of crystalline substance 5 was added and mixed and dissolved thereinto. This was followed by the dissolution of 5.0 parts of the polymerization initiator tert-butyl peroxypivalate.

This polymerizable monomer composition was introduced into the aqueous medium described above and stirring was carried out at 60° C. under a nitrogen atmosphere for 10 minutes at 12,000 rpm using a TK Homomixer (by Tokushu Kika Kogyo Co., Ltd. (today's PRIMIX Corporation)) to form particles of the polymerizable monomer composition.

After this, a polymerization reaction was run for 4 hours at 70° C. while stirring with a paddle stirring blade. After the completion of the reaction, it was confirmed that coloring particles were dispersed in the obtained aqueous medium and that calcium phosphate was attached as a poorly water-soluble inorganic dispersing agent to the surface of the coloring particles.

At this point, hydrochloric acid was added to the aqueous medium to wash off and remove the calcium phosphate, followed by filtration and drying and analysis of the coloring particles. According to the results, the glass transition temperature Tg of the coloring particles was 55° C.

Then, for step (I), a dispersion provided by dispersing the coloring particles in the aqueous medium was heated to 99° C. (temperature $T_A$) and held for 30 minutes.

After this, for step (II), 5° C. water was introduced into the dispersion and cooling from 99° C. to 50° C. was performed at a cooling rate of 135.0° C./minute. (In this case, the starting temperature T1 is 99° C., the stopping temperature T2 is 50° C., and cooling rate 1 is 135.0° C./minute.)

Then, for step (III), the dispersion that had gone through step (II) was held for 120 minutes at 50° C. (in this case, the start temperature T3 is 50° C., T4 is 50° C., and the holding time in the temperature region from the Tg−10° C. to the Tg+10° C. is 120 minutes).

The cooling rate 2 in step (III) was 0.00° C./minute. The ratio of the cooling rate 2 to the cooling rate 1 was 0.00.

Hydrochloric acid was subsequently added to the dispersion to wash out and remove the calcium phosphate, followed by filtration and drying to obtain a toner particle 1 that had a weight-average particle diameter (D4) of 8.0 μm.

A toner 1 was obtained by mixing, using an FM mixer (Nippon Coke & Engineering Co., Ltd.), 100 parts of the toner particle 1 with 0.8 parts of hydrophobic silica fine particles that had a BET value of 300 $m^2/g$ and a number-average primary particle diameter of 8 nm.

An analysis of toner 1 gave the following: the total of the styrene and n-butyl acrylate constituting the binder resin in toner 1 was 100 parts; the glass transition temperature Tg of toner 1 was 55° C.; the weight-average molecular weight (Mw) of the binder resin was 45,000; and the ratio of the weight-average molecular weight (Mw) of the binder resin to the weight-average molecular weight (Mw) of the crystalline substance was 39.1. The production conditions for and properties of toner 1 are given in Table 3. Here, the weight-average molecular weight (Mw) of the coloring particle and toner was the same as the weight-average molecular weight (Mw) of the binder resin.

<Production Example for Toners 2 to 10 and Comparative Toners 13, 14, and 17>

Toners 2 to 10 and comparative toners 13, 14, and 17 were produced proceeding as in the Toner 1 Production Example, but changing the number of parts of the polymerization initiator, the type of crystalline substance, the type and number of parts of the amorphous resin C, the type of dispersing agent, and/or the conditions in step (I), step (II), and step (III) as indicated in Table 3 or Table 4. The temperature $T_A$ was the same temperature as the cooling starting temperature T1 in all of these toner production examples.

In the production example for comparative toner particle 13, the dispersion was cooled to 25° C. followed by the addition of hydrochloric acid to wash out and remove the calcium phosphate and then filtration. This was followed by drying for 72 hours in a 40° C. dryer to obtain comparative toner particle 13. The production conditions for and properties of the obtained toners and comparative toners are given in Table 3 and Table 4.

<Toner 11 Production Example>

(Binder Resin Production)

The molar ratios for the starting monomers for polyester production are as follows.

BPA-PO:BPA-EO:TPA:TMA=50:45:70:12

Here, BPA-PO refers to the adduct of 2.2 moles of propylene oxide on bisphenol A; BPA-EO refers to the adduct of 2.2 moles of ethylene oxide on bisphenol A; TPA refers to terephthalic acid; and TMA refers to trimeilitic anhydride.

Of the starting monomers indicated above, the starting monomers other than the TMA and 0.1 mass % of tetrabutyl titanate as catalyst were introduced into a flask fitted with a water separator, stirring blade, and nitrogen introduction line and a condensation polymerization was run for 10 hours at 220° C. The TMA was added and a reaction was run at 210° C. until the desired acid value was reached to obtain an amorphous polyester resin (glass transition temperature Tg=55° C., acid value=17 mg KOH/g, weight-average molecular weight=9,000).

(Toner Production)

| | |
|---|---|
| amorphous polyester resin | 100.0 parts |
| resin C-3 | 3.0 parts |
| iron complex of monoazo dye (T-77: by Hodogaya Chemical Co., Ltd.) | 1.5 parts |
| magnetic body 1 | 90.0 parts |
| crystalline substance 4 | 10.0 parts |

These starting materials were preliminarily mixed using an FM mixer (by Nippon Coke & Engineering Co., Ltd.). This was followed by melt kneading using a twin-screw kneading extruder (PCM-30: by Ikegai Corp) at a rotation rate of 200 rpm, with the set temperature adjusted to provide a direct temperature for the kneaded material in the vicinity of the outlet of 140° C.

The obtained melt-kneaded material was cooled, and the cooled melt-kneaded material was coarsely pulverized with a cutter mill. The obtained coarsely pulverized material was then finely pulverized using a Turbomill T-250 (by Turbo Kogyo Co., Ltd. (today's Freund Turbo)) followed by classification using a Coanda effect-based multi-grade classifier to obtain a coloring particle having a weight-average particle diameter (D4) of 8.0 μm.

450 parts of a 0.1 mol/L aqueous $Na_3PO_4$ solution was introduced into 720 parts of deionized water; heating to 60° C. was carried out; and 67.7 parts of a 1.0 mol/L aqueous $CaCl_2$ solution was added to obtain an aqueous medium that contained a dispersing agent.

100 parts of the aforementioned coloring particle was introduced into this aqueous medium and this was stirred with a paddle stirring blade to obtain a dispersion in which the coloring particle was dispersed in the aqueous medium. It was confirmed at this point that calcium phosphate was attached as a poorly water-soluble inorganic dispersing agent to the surface of the coloring particle.

At this point, hydrochloric acid was added to the aqueous medium to wash off and remove the calcium phosphate, followed by filtration and drying and analysis of the coloring particles. According to the results, the glass transition temperature Tg of the coloring particles was 55° C.

Then, for step (I), a dispersion provided by dispersing the coloring particles in the aqueous medium was heated to 78° C. (temperature $T_A$) and held for 30 minutes.

After this, for step (II), 5° C. water was introduced into the dispersion and cooling from 78° C. to 50° C. was performed at a cooling rate of 135.0° C./minute. (In this case, the starting temperature T1 is 78° C., the stopping temperature T2 is 50° C., and the cooling rate is 135.0° C./minute.)

Then, for step (III), the dispersion that had gone through step (II) was held for 120 minutes at 50° C. (in this case, the start temperature T3 is 50° C., T4 is 50° C., and the holding time in the temperature region from the Tg−10° C. to the Tg+10° C. is 120 minutes).

The cooling rate 2 in step (III) was 0.00° C./minute. The ratio of the cooling rate 2 to the cooling rate 1 was 0.00.

Hydrochloric acid was subsequently added to the dispersion to wash out and remove the calcium phosphate, followed by filtration and drying to obtain a toner particle 11 that had a weight-average particle diameter (D4) of 8.0 μm.

A toner 11 was obtained by mixing, using an FM mixer, 100 parts of the toner particle 11 with 0.8 parts of hydrophobic silica fine particles that had a BET value of 300 m/g and a number-average primary particle diameter of 8 nm.

An analysis of toner 11 gave the following: the amorphous polyester resin constituting the binder resin in toner 11 was 100 parts; the glass transition temperature Tg of toner 11 was 55° C.; the weight-average molecular weight (Mw) of the binder resin was 9,000; and the ratio of the weight-average molecular weight (Mw) of the binder resin to the weight-average molecular weight (Mw) of the crystalline substance was 19.2. The production conditions for and properties of toner 11 are given in Table 3. Here, the weight-average molecular weight (Mw) of the coloring particle and toner was the same as the weight-average molecular weight (Mw) of the binder resin.

<Production Example for Toners 12 to 20 and Comparative Toners 1 to 12, 15, 16, and 18>

Toners 12 to 20 and comparative toners 1 to 12, 15, 16, and 18 were produced proceeding as in the Toner 1. Production Example, but changing the type of binder resin, the type of crystalline substance, the type and number of parts of the amorphous resin C, the type of dispersing agent, and/or the conditions in step (I), step (II), and step (III) as indicated in Table 3 or Table 4.

A styrene-acrylic resin [copolymer of styrene (75 parts) and butyl acrylate (25 parts), weight-average molecular weight (Mw)=9,000, glass transition temperature Tg (° C.)=55° C.] was used as the binder resin in comparative toner 2, comparative toners 8 to 12, and comparative toners 15 and 16.

With toners 17 to 20, the rapid cooling in step (II) was followed by reheating and the execution of step (III). In addition, as for toner 18, a gentle cooling was carried out in step (III), and the start temperature T3 in step (III) was 65° C. while T4 was 45° C. and this cooling rate 2 was controlled to 0.17° C./minute.

That is, the holding time in the temperature region of the Tg−10° C. and the Tg+10° C. was 120 minutes and the cooling rate 2 in step (II) was 0.17° C./minute. The ratio of the cooling rate 2 to the cooling rate 1 was 0.03.

In the production example for comparative toner particle 16, immediately after melt kneading, the melt-kneaded material was cooled to 55° C. at a cooling rate of 135.0° C./minute and a dry annealing treatment of holding for 120 minutes at 55° C. was carried out (that is, a treatment step in an aqueous medium was not used with comparative toner particle 16).

The production conditions for and properties of the obtained toner particles and comparative toner particles are given in Table 3 and Table 4.

In all of these toner production examples, the temperature $T_A$ and the cooling starting temperature T1 were the same temperature.

TABLE 3

| | coloring particle | | | | | | | | | | |
|---|---|---|---|---|---|---|---|---|---|---|---|
| | | | | | binder resin | | | | | | |
| toner No. | coloring particle production method | toner Tg (° C.) | coloring particle Tg (° C.) | crystalline substance No. | number of parts of polymerization initiator | type | Mw | Mw of binder resin/ Mw of crystalline substance | amorphous resin C type | amorphous resin C number of parts | dispersing agent |
| 1 | A | 55 | 55 | 5 | 5.0 | C | 45000 | 19.1 | C1 | 3.0 | E |
| 2 | A | 55 | 55 | 1 | 5.0 | C | 45000 | 24.3 | C1 | 3.0 | E |
| 3 | A | 55 | 55 | 2 | 6.0 | C | 30000 | 36.7 | C1 | 3.0 | E |
| 4 | A | 55 | 55 | 2 | 6.0 | C | 30000 | 36.7 | C2 | 10.0 | E |
| 5 | A | 55 | 55 | 2 | 6.0 | C | 30000 | 36.7 | C3 | 10.0 | E |
| 6 | A | 55 | 55 | 2 | 6.0 | C | 30000 | 36.7 | C2 | 15.0 | E |
| 7 | A | 55 | 55 | 3 | 6.0 | C | 30000 | 47.2 | C3 | 10.0 | E |
| 8 | A | 55 | 55 | 3 | 6.0 | C | 30000 | 47.2 | C3 | 10.0 | E |
| 9 | A | 55 | 55 | 3 | 9.0 | C | 17000 | 26.7 | C3 | 10.0 | E |
| 10 | A | 55 | 55 | 4 | 13.0 | C | 9000 | 19.2 | C3 | 10.0 | E |
| 11 | B | 55 | 55 | 4 | — | D | 9000 | 19.2 | C3 | 3.0 | E |
| 12 | B | 55 | 55 | 4 | — | D | 9000 | 19.2 | C3 | 10.0 | F |
| 13 | B | 55 | 55 | 4 | — | D | 9000 | 19.2 | C3 | 10.0 | F |
| 14 | B | 55 | 55 | 4 | — | D | 9000 | 19.2 | C3 | 10.0 | F |
| 15 | B | 55 | 55 | 4 | — | D | 9000 | 19.2 | C3 | 10.0 | F |
| 16 | B | 55 | 55 | 4 | — | D | 9000 | 19.2 | C3 | 10.0 | F |
| 17 | B | 55 | 55 | 4 | — | D | 9000 | 19.2 | C3 | 10.0 | F |
| 18 | B | 55 | 55 | 4 | — | D | 9000 | 19.2 | C3 | 10.0 | F |
| 19 | B | 55 | 55 | 4 | — | D | 9000 | 19.2 | C3 | 10.0 | F |
| 20 | B | 55 | 55 | 4 | — | D | 9000 | 19.2 | — | — | F |

| | steps (I) and (II) | | | step (III) | | | | |
|---|---|---|---|---|---|---|---|---|
| toner No. | TA (° C.) | T2 (° C.) | cooling rate 1 (° C./minute) | T3 (° C.) | T4 (° C.) | cooling rate 2 (° C./minute) | holding time (minute) | cooling rate 2/cooling rate 1 |
| 1 | 99 | 50 | 135.0 | 50 | 50 | 0.00 | 120 | 0.00 |
| 2 | 95 | 50 | 135.0 | 50 | 50 | 0.00 | 120 | 0.00 |
| 3 | 95 | 50 | 135.0 | 50 | 50 | 0.00 | 120 | 0.00 |
| 4 | 95 | 50 | 135.0 | 50 | 50 | 0.00 | 120 | 0.00 |
| 5 | 95 | 50 | 135.0 | 50 | 50 | 0.00 | 120 | 0.00 |
| 6 | 95 | 50 | 135.0 | 50 | 50 | 0.00 | 120 | 0.00 |
| 7 | 78 | 50 | 135.0 | 50 | 50 | 0.00 | 120 | 0.00 |
| 8 | 73 | 50 | 135.0 | 50 | 50 | 0.00 | 120 | 0.00 |
| 9 | 73 | 50 | 135.0 | 50 | 50 | 0.00 | 120 | 0.00 |
| 10 | 78 | 50 | 135.0 | 50 | 50 | 0.00 | 120 | 0.00 |
| 11 | 78 | 50 | 135.0 | 50 | 50 | 0.00 | 120 | 0.00 |
| 12 | 78 | 50 | 135.0 | 50 | 50 | 0.00 | 120 | 0.00 |
| 13 | 78 | 50 | 95.0 | 50 | 50 | 0.00 | 120 | 0.00 |
| 14 | 78 | 50 | 55.0 | 50 | 50 | 0.00 | 90 | 0.00 |
| 15 | 78 | 45 | 55.0 | 55 | 55 | 0.00 | 30 | 0.00 |

TABLE 3-continued

| | | | | | | | | |
|---|---|---|---|---|---|---|---|---|
| 16 | 78 | 45 | 5.0 | 55 | 55 | 0.00 | 30 | 0.00 |
| 17 | 78 | 45 | 5.0 | 65 | 65 | 0.00 | 30 | 0.00 |
| 18 | 78 | 55 | 5.0 | 65 | 45 | 0.17 | 120 | 0.03 |
| 19 | 78 | 55 | 5.0 | 65 | 45 | 0.33 | 60 | 0.07 |
| 20 | 78 | 55 | 5.0 | 65 | 45 | 0.67 | 30 | 0.13 |

In the Table, with regard to the production method for the coloring particle, A refers to suspension polymerization and B refers to pulverization. For the binder resins, C refers to styrene-acrylic resin and D refers to amorphous polyester resin. For the dispersing agents, E refers to calcium phosphate and F refers to sodium dodecylbenzenesulfonate.

In the Table, with regard to the production method for the coloring particle, A refers to suspension polymerization and B refers to pulverization. For the binder resins, C refers to styrene-acrylic resin and D refers to amorphous polyester resin. For the dispersing agents, E refers to calcium phosphate and F refers to sodium dodecylbenzenesulfonate.

TABLE 4

| | coloring particle | | | | | | | | | | |
|---|---|---|---|---|---|---|---|---|---|---|---|
| | | | | | binder resin | | | | | | |
| comparative toner No. | coloring particle production method | toner Tg (° C.) | coloring particle Tg (° C.) | crystalline substance No. | number of parts of polymerization initiator | type | Mw | Mw of binder resin/ Mw of crystalline substance | amorphous resin C type | amorphous resin C number of parts | dispersing agent |
| 1 | B | 55 | 55 | 4 | — | D | 9000 | 19.2 | — | — | F |
| 2 | B | 55 | 55 | 2 | — | C | 9000 | 11.0 | — | — | E |
| 3 | B | 55 | 55 | 4 | — | D | 9000 | 19.2 | — | — | F |
| 4 | B | 55 | 55 | 4 | — | D | 9000 | 19.2 | — | — | F |
| 5 | B | 55 | 55 | 4 | — | D | 9000 | 19.2 | — | — | F |
| 6 | B | 55 | 55 | 4 | — | D | 9000 | 19.2 | — | — | F |
| 7 | B | 55 | 55 | 3 | — | D | 9000 | 14.2 | — | — | F |
| 8 | B | 55 | 55 | 4 | — | C | 9000 | 19.2 | — | — | F |
| 9 | B | 55 | 55 | 3 | — | C | 9000 | 14.2 | — | — | F |
| 10 | B | 55 | 55 | 3 | — | C | 9000 | 14.2 | — | — | F |
| 11 | B | 55 | 55 | 3 | — | C | 9000 | 14.2 | — | — | F |
| 12 | B | 55 | 55 | 3 | — | C | 9000 | 14.2 | — | — | F |
| 13 | A | 55 | 55 | 3 | 9.0 | C | 17000 | 26.7 | C3 | 10.0 | E |
| 14 | A | 55 | 55 | 3 | 13.0 | C | 9000 | 14.2 | — | — | F |
| 15 | B | 55 | 55 | 2 | — | C | 9000 | 11.0 | — | — | E |
| 16 | B | 55 | 55 | 5 | 5.0 | C | 45000 | 19.1 | C1 | 3.0 | — |
| 17 | A | 55 | 55 | 3 | 9.0 | C | 17000 | 26.7 | C3 | 10.0 | E |
| 18 | B | 55 | 55 | 4 | — | D | 9000 | 19.2 | — | — | F |

| | steps (I) and (II) | | | step (III) | | | | |
|---|---|---|---|---|---|---|---|---|
| comparative toner No. | TA (° C.) | T2 (° C.) | cooling rate 1 (° C./minute) | T3 (° C.) | T4 (° C.) | cooling rate 2 (° C./minute) | holding time (minute) | cooling rate 2/cooling rate 1 |
| 1 | 78 | 45 | 5.0 | 55 | 55 | 0.00 | 20 | 0.00 |
| 2 | 73 | 45 | 3.0 | 55 | 55 | 0.00 | 30 | 0.00 |
| 3 | 78 | 45 | 3.0 | 55 | 55 | 0.00 | 120 | 0.00 |
| 4 | 70 | 45 | 5.0 | 55 | 55 | 0.00 | 30 | 0.00 |
| 5 | 95 | 40 | 55.0 | 40 | 40 | 0.00 | 0 | 0.00 |
| 6 | 78 | 40 | 55.0 | 40 | 40 | 0.00 | 0 | 0.00 |
| 7 | 72 | 25 | 55.0 | 25 | 25 | 0.00 | 0 | 0.00 |
| 8 | 95 | 40 | 55.0 | 40 | 25 | 2.00 | 0 | 0.04 |
| 9 | 95 | 45 | 55.0 | 45 | 25 | 2.00 | 0 | 0.04 |
| 10 | 73 | 45 | 55.0 | 45 | 25 | 2.00 | 0 | 0.04 |
| 11 | 73 | 50 | 55.0 | 50 | 25 | 2.00 | 2.5 | 0.04 |
| 12 | 73 | 55 | 55.0 | 55 | 25 | 2.00 | 5 | 0.04 |
| 13 | 90 | 25 | 55.0 | 25 | 25 | 0.00 | 0 | 0.00 |
| 14 | 73 | 40 | 55.0 | 40 | 25 | 2.00 | 0 | 0.04 |
| 15 | 90 | 45 | 0.5 | 55 | 55 | 0.00 | 300 | 0.00 |
| 16 | 95 | 50 | 135.0 | 55 | 55 | 0.00 | 120 | 0.00 |
| 17 | 99 | 25 | 55.0 | 25 | 25 | 0.00 | 0 | 0.00 |
| 18 | 95 | 70 | 55.0 | 70 | 45 | 0.04 | 500 | 0.00 |

Example 1

(Evaluation of the Low-Temperature Fixability)

The following evaluation was carried out using toner 1.

The evaluation was performed in a 23° C./50% RH environment. Fox River Bond paper (110 g/m$^2$) was used for the fixing media. By using a media that is a thick paper and that presents relatively large surface asperities, a rigorous evaluation of the low-temperature fixability can be carried out by establishing conditions that facilitate rubbing. A commercial LBP-3100 (by Canon Inc.) was used for the image-forming apparatus, and a modified machine was used in which the printing speed had been modified from 16 prints/minute to 32 prints/minute. A particularly rigorous evaluation of the low-temperature fixability can be carried out due to the increase in the printing speed.

With regard to the evaluation procedure, from a condition in which the fixing unit as a whole was cooled to room temperature, image output was carried out at a set temperature of 150° C. with adjustment of the halftone image density to provide an image density (measured using a MacBeth reflection densitometer (by GretagMacbeth GmbH (today's X-Rite Inc.)) on the Fox River Bond paper of at least 0.75 and not more than 0.80.

After this, the fixed halftone image was rubbed 10 times with lens-cleaning paper carrying a load of 55 g/cm$^2$. Using the following formula, the density decline at 150° C. was calculated from the halftone image density before and after the rubbing.

density decline (%)=(image density before rubbing−image density after rubbing)/image density before rubbing×100

Proceeding similarly, the fixation temperature was raised in 5° C. increments and the density decline was similarly calculated up to and including 180° C.

Using the fixation temperatures and the results of the evaluation of the density decline obtained in this series of operations, a relationship between the fixation temperature and the density decline was obtained using second-order polynomial approximation. Using this relationship, the temperature that provided a density decline of 15% was calculated, and this temperature was taken to be the fixation temperature Indicating the threshold value at which the low-temperature fixability is excellent. A lower fixation temperature indicates a better low-temperature fixability. The obtained fixation temperature is given in Table 5 as the low-temperature fixability.

(Evaluation of the Fogging)

The following evaluation was carried out using toner 1.

A commercial LBP-3100 (by Canon Inc.) was used as the image-forming apparatus; its printing speed was modified from 16 prints/minute to 32 prints/minute. Doing this enables a more rigorous evaluation to be carried out.

The paper used was A4 Color Laser Copy Paper (by Canon Inc., 80 g/m$^2$).

A white image was output and its reflectance was measured using a Model TC-6DS Reflectometer from Tokyo Denshoku Co., Ltd. The reflectance was also similarly measured on the transfer paper before formation of the white image. The filter used was a green filter. The fogging was calculated using the following formula from the reflectance before and after output of the white image.

fogging(reflectance) (%)=reflectance (%) of the transfer paper−reflectance (%) of the white image The evaluation criteria for the fogging are given below. The results of the evaluation are given in Table 5.

A: less than 1.0% very good
B: at least 1.0% and less than 3.0% good
C: at least 3.0% and less than 5.0% fair
D: at least 5.0% poor (Evaluation of the Crystalline Substance Outmigration Ratio)

The crystalline substance outmigration ratio was measured using the method described above for calculating the outmigration ratio of the crystalline substance at the toner surface.

The outmigration of large amounts of the crystalline substance to the toner surface causes fogging to become substantial and may cause a decline in the latent electrophotographic properties.

The criteria for evaluating the crystalline substance outmigration ratio are given below. The results are given in Table 5.

A: less than 3.0% very good
B: at least 3.0% and less than 8.03 good
C: at least 8.0% and less than 15.0% fair
D: at least 15.0% poor (Analysis of the Number of Crystalline Substance Domains)

An analysis of the number of crystalline substance domains was carried out on toner 1, and the number of domains of at least 5 nm and not more than 500 nm, which are effective with regard to the low-temperature fixability, was evaluated. The results of the evaluation are given in Table 5.

The evaluation criteria for the influence of the number of crystalline substance domains on the low-temperature fixability are as follows.

A: at least 220 very good
B: at least 80 and less than 120 good
C: at least 20 and less than 80 fair
D: less than 20 poor (Procedure for Standing in a Harsh Environment)

Figure 5:
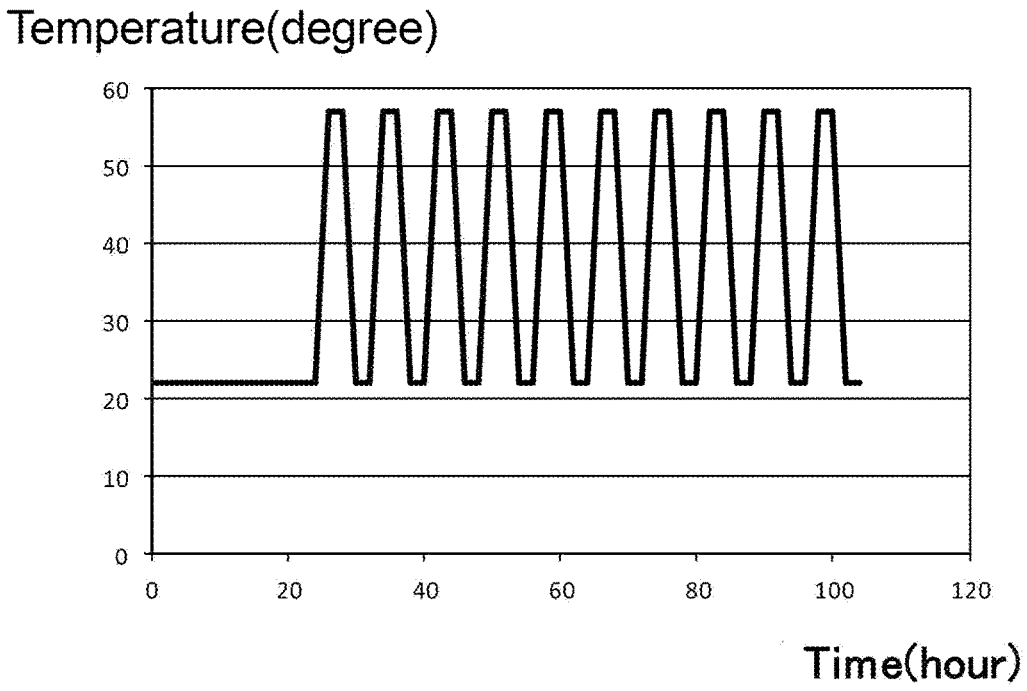
FIG. 5 is a diagram that shows the temperature transitions during standing in a harsh environment.

Toner 1 was subjected to a 24-hour ageing treatment by standing in a thermostat adjusted to 22° C. and 90% RH. This was followed by adjustment to 57° C. and 90% RH by heating over 2 hours at a pace of 17.5° C. per 1 hour. Bolding was carried out for 2 hours in this condition, followed by cooling at a pace of 17.5° C. per 1 hour to return to 22° C. and 90% RH. After holding for 2 hours, heating was carried out again. Proceeding in this manner, heating and cooling were carried out 10 times, as shown in FIG. 5, using a temperature and humidity of 22° C. and 90% RH and 57° C. and 90% RH.

The use of this mode imposes rapid thermal fluctuations on the toner, and by imposes many high temperature/low temperature repetitions, material motion in the toner interior is promoted and the outmigration of the crystalline substance to the toner surface is facilitated. Evaluations carried out in such a harsh environment are rigorous evaluations of the toner.

(Evaluation of the Fogging and Crystalline Substance Outmigration Ratio after Standing in a Harsh Environment)

The fogging and crystalline substance outmigration ratio were measured on toner 1 after it had been subjected to the aforementioned standing in a harsh environment, and the evaluations were performed using the evaluation criteria given above. The results of the evaluations are given in Table 5.

Examples 2 to 20 and Comparative Examples 1 to 18

The same evaluations as carried out in Example 1 were carried out using toners 2 to 20 and comparative toners 1 to 18. The obtained results are given in Table 5 or Table 6.

TABLE 5

| example | toner No. | low-temperature fixability (° C.) | number of crystalline substance domains (number) | initial fogging (%) | initial evaluation | initial outmigration ratio (%) | initial evaluation | after standing in a harsh environment fogging (%) | after standing in a harsh environment evaluation | after standing in a harsh environment outmigration ratio (%) | after standing in a harsh environment evaluation |
|---|---|---|---|---|---|---|---|---|---|---|---|
| 1 | 1 | 150 | 150 | 0.5 | A | 0.5 | A | 0.7 | A | 0.7 | A |
| 2 | 2 | 152 | 140 | 0.5 | A | 0.5 | A | 0.8 | A | 0.7 | A |
| 3 | 3 | 152 | 140 | 0.5 | A | 0.5 | A | 0.8 | A | 0.7 | A |
| 4 | 4 | 152 | 140 | 0.5 | A | 0.5 | A | 0.8 | A | 0.7 | A |
| 5 | 5 | 154 | 135 | 0.6 | A | 0.5 | A | 1.0 | B | 0.7 | A |
| 6 | 6 | 154 | 133 | 0.6 | A | 0.7 | A | 1.0 | B | 0.7 | A |
| 7 | 7 | 155 | 128 | 0.6 | A | 0.7 | A | 1.1 | B | 0.9 | A |
| 8 | 8 | 155 | 120 | 0.7 | A | 0.8 | A | 1.3 | B | 1.4 | A |
| 9 | 9 | 156 | 110 | 0.8 | A | 1.3 | A | 1.6 | B | 1.9 | A |
| 10 | 10 | 160 | 80 | 0.8 | A | 1.6 | A | 2.0 | B | 2.2 | A |
| 11 | 11 | 161 | 55 | 1.0 | B | 1.7 | A | 2.6 | B | 2.5 | A |
| 12 | 12 | 162 | 55 | 1.2 | B | 3.3 | B | 3.0 | C | 5.3 | B |
| 13 | 13 | 163 | 50 | 1.3 | B | 3.5 | B | 3.2 | C | 5.6 | B |
| 14 | 14 | 163 | 45 | 1.4 | B | 4.0 | B | 3.6 | C | 6.2 | B |
| 15 | 15 | 163 | 44 | 1.4 | B | 5.5 | B | 3.8 | C | 6.3 | B |
| 16 | 16 | 170 | 25 | 1.5 | B | 6.3 | B | 4.0 | C | 7.6 | B |
| 17 | 17 | 171 | 25 | 1.6 | B | 6.4 | B | 4.1 | C | 7.7 | B |
| 18 | 18 | 172 | 23 | 1.6 | B | 6.5 | B | 4.1 | C | 7.8 | B |
| 19 | 19 | 175 | 22 | 1.7 | B | 6.7 | B | 4.2 | C | 7.8 | B |
| 20 | 20 | 171 | 20 | 1.8 | B | 7.2 | B | 4.4 | C | 8.0 | C |

TABLE 6

| comparative example | comparative toner No. | low-temperature fixability (° C.) | number of crystalline substance domains (number) | initial fogging (%) | initial evaluation | initial outmigration ratio (%) | initial evaluation | after standing in a harsh environment fogging (%) | after standing in a harsh environment evaluation | after standing in a harsh environment outmigration ratio (%) | after standing in a harsh environment evaluation |
|---|---|---|---|---|---|---|---|---|---|---|---|
| 1 | 1 | 175 | 10 | 2.4 | B | 9.5 | C | 5.8 | D | 14.9 | C |
| 2 | 2 | 182 | 0 | 2.6 | B | 12.0 | C | 6.3 | D | 24.1 | D |
| 3 | 3 | 183 | 0 | 2.8 | B | 10.0 | C | 6.6 | D | 24.0 | D |
| 4 | 4 | 182 | 0 | 2.7 | B | 11.9 | C | 6.7 | D | 20.1 | D |
| 5 | 5 | 163 | 0 | 3.0 | C | 9.6 | C | 6.8 | D | 22.0 | D |
| 6 | 6 | 164 | 0 | 3.1 | C | 9.7 | C | 7.2 | D | 19.2 | D |
| 7 | 7 | 161 | 0 | 2.8 | B | 10.3 | C | 6.6 | D | 22.0 | D |
| 8 | 8 | 160 | 0 | 2.8 | B | 11.0 | C | 7.0 | D | 23.0 | D |
| 9 | 9 | 162 | 0 | 3.1 | C | 10.5 | C | 7.2 | D | 24.0 | D |
| 10 | 10 | 164 | 0 | 3.0 | C | 9.5 | C | 7.3 | D | 24.3 | D |
| 11 | 11 | 162 | 2 | 2.9 | B | 10.3 | C | 7.4 | D | 20.1 | D |
| 12 | 12 | 161 | 3 | 2.8 | B | 10.4 | C | 6.9 | D | 22.0 | D |
| 13 | 13 | 161 | 0 | 2.8 | B | 12.4 | C | 7.2 | D | 28.3 | D |
| 14 | 14 | 161 | 0 | 2.6 | B | 13.1 | C | 7.1 | D | 26.3 | D |
| 15 | 15 | 162 | 0 | 3.2 | C | 14.3 | C | 7.1 | D | 29.2 | D |
| 16 | 16 | 161 | 0 | 3.4 | C | 15.2 | D | 7.2 | D | 31.2 | D |
| 17 | 17 | 163 | 0 | 3.2 | C | 15.9 | D | 7.6 | D | 33.2 | D |
| 18 | 18 | 161 | 0 | 2.8 | B | 16.1 | D | 6.8 | D | 31.3 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-237858, filed Dec. 4, 2015, Japanese Patent Application No. 2016-208362, filed Oct. 25, 2016 which are hereby incorporated by reference herein in their entirety.

What is claimed is:

1. A method for producing a toner comprising a toner particle containing a binder resin, a colorant, and a crystalline substance, wherein the method comprises the steps of:

(I) setting a temperature of a dispersion, in which a coloring particle is dispersed with an aqueous medium, to $T_A$(° C.), the $T_A$(° C.) being higher than the higher of a crystallization temperature Tc(° C.) of the crystalline substance and a glass transition temperature Tg(° C.) of the coloring particle, the coloring particle containing the binder resin, the colorant, and the crystalline substance;

(II) cooling the dispersion from the $T_A$ to a temperature equal to or lower than the Tg at a cooling rate of at least 5.0° C./min after the step (I); and (III) holding the dispersion in a temperature range of at least Tg−10(° C.) and not more than Tg+10(° C.) for at least 30 min after the step (II).

2. The method for producing a toner according to claim 1, wherein the crystalline substance satisfies at least one of the following (i) and (ii):

(i) a melting point Tm (° C.) of the crystalline substance is at least 50° C. and not more than 90° C.; and (ii) a weight-average molecular weight (Mw) of the crystalline substance is at least 1,000, and a ratio of the weight-average molecular weight (Mw) of the crystalline substance to a number-average molecular weight (Mn) of the crystalline substance is at least 1.6.

3. The method for producing a toner according to claim 1, wherein the dispersion comprises a poorly water-soluble inorganic dispersing agent.

4. The method for producing a toner according to claim 1, wherein the binder resin comprises a styrene-acrylic resin.

5. The method for producing a toner according to claim 1, wherein the $T_A$ is a temperature that is at least 5° C. and not more than 22° C. higher than the higher of the Tc (° C.) and the Tg (° C.).

6. The method for producing a toner according to claim 1, wherein the coloring particle contains an amorphous resin C which is different from the binder resin, a content of the amorphous resin C is at least 1 mass part and not more than 10 mass parts, per 100 mass parts of the binder resin, and a glass transition temperature Tgc (° C.) of the amorphous resin C is at least 10° C. higher than the Tg (° C.).

7. The method for producing a toner according to claim 1, wherein the crystalline substance is an aliphatic hydrocarbon wax or an ester wax.

* * * * *